US008008566B2

(12) United States Patent
Walker, II et al.

(10) Patent No.: US 8,008,566 B2
(45) **Date of Patent: *Aug. 30, 2011**

(54) METHODS, SYSTEMS AND COMPUTER PROGRAM PRODUCTS FOR DETECTING MUSICAL NOTES IN AN AUDIO SIGNAL

(75) Inventors: John Q. Walker, II, Raleigh, NC (US); Peter J. Schwaller, Raleigh, NC (US); Andrew H. Gross, Sunnyvale, CA (US)

(73) Assignee: Zenph Sound Innovations Inc., Raleigh, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/556,926

(22) Filed: Sep. 10, 2009

(65) Prior Publication Data

US 2010/0000395 A1 Jan. 7, 2010

Related U.S. Application Data

(63) Continuation of application No. 10/977,850, filed on Oct. 29, 2004, now Pat. No. 7,598,447.

(51) Int. Cl.
*G10H 1/00* (2006.01)

(52) U.S. Cl. ..... 84/609; 84/608; 84/616; 84/623

(58) Field of Classification Search ..... 84/600–602, 84/608, 609, 616, 623

See application file for complete search history.

(56) References Cited

U.S. PATENT DOCUMENTS

| | | | | |
|---|---|---|---|---|
| 4,273,023 | A | 6/1981 | Mercer | 84/454 |
| 4,377,961 | A | 3/1983 | Bode | 84/681 |
| 4,457,203 | A | 7/1984 | Schoenberg et al. | 84/454 |
| 4,463,650 | A | 8/1984 | Rupert | 84/654 |
| 4,479,416 | A | 10/1984 | Clague | 84/462 |
| 4,633,748 | A | 1/1987 | Takashima et al. | 84/603 |
| 4,665,790 | A | 5/1987 | Rothschild | 84/454 |
| 4,688,464 | A | 8/1987 | Gibson et al. | 84/454 |
| 5,038,658 | A | 8/1991 | Tsuruta et al. | 84/461 |
| 5,202,528 | A | 4/1993 | Iwaooji | 84/616 |
| 5,210,366 | A | 5/1993 | Sykes, Jr. | 84/616 |
| 5,349,130 | A | 9/1994 | Iwaooji | 84/616 |
| 5,357,045 | A | 10/1994 | Tabei | 84/603 |

(Continued)

FOREIGN PATENT DOCUMENTS

JP 2003-255951 9/2003

(Continued)

OTHER PUBLICATIONS

Klapuri, Anssi, "Automatic Transcription of Music", Master of Science Thesis, Tampere University of Technology, 82 pages (Apr. 1998).

(Continued)

*Primary Examiner* — David S. Warren
(74) *Attorney, Agent, or Firm* — Myers Bigel Sibley & Sajovec

(57) ABSTRACT

Methods, system and/or computer program products for detection of a note include receiving an audio signal and generating a plurality of frequency domain representations of the audio signal over time. A time domain representation is generated from the plurality of frequency domain representations. A plurality of edges are detected in the time domain representation and the note is detected by selecting one of the plurality of edges as corresponding to the note based on characteristics of the time domain representation.

32 Claims, 13 Drawing Sheets

U.S. PATENT DOCUMENTS

| | | | | |
|---|---|---|---|---|
| 5,619,004 | A | 4/1997 | Dame | 84/616 |
| 5,693,903 | A | 12/1997 | Heidorn et al. | 84/668 |
| 5,719,344 | A | 2/1998 | Pawate | 84/609 |
| 5,812,688 | A | 9/1998 | Gibson | |
| 5,942,709 | A | 8/1999 | Szalay | 84/616 |
| 5,986,198 | A | 11/1999 | Gibson et al. | 84/603 |
| 5,986,199 | A | 11/1999 | Peevers | 84/603 |
| 6,124,544 | A | 9/2000 | Alexander et al. | 84/616 |
| 6,140,568 | A | 10/2000 | Kohler | 84/616 |
| 6,355,869 | B1 | 3/2002 | Mitton | 84/603 |
| 6,392,132 | B2 | 5/2002 | Uehara | 84/477 R |
| 6,541,691 | B2 | 4/2003 | Tolonen et al. | 84/616 |
| 6,664,458 | B2 | 12/2003 | Hiratsuka et al. | 84/477 R |
| 6,725,108 | B1 | 4/2004 | Hall | 700/94 |
| 6,787,689 | B1 | 9/2004 | Chen | 84/600 |
| 6,856,923 | B2 | 2/2005 | Jung | 702/71 |
| 6,930,236 | B2 | 8/2005 | Jung | 84/616 |
| 7,064,262 | B2 | 6/2006 | Klefenz et al. | |
| 7,096,186 | B2 | 8/2006 | Funaki | 704/278 |
| 7,149,682 | B2 | 12/2006 | Yoshioka et al. | 704/205 |
| 7,202,407 | B2 | 4/2007 | Kawashima et al. | 84/609 |
| 7,317,958 | B1 | 1/2008 | Freed et al. | 700/94 |
| 7,323,629 | B2 | 1/2008 | Somani et al. | 84/470 R |
| 7,442,870 | B2 | 10/2008 | Lengeling et al. | |
| 7,598,447 | B2 * | 10/2009 | Walker et al. | 84/616 |
| 2001/0036620 | A1 | 11/2001 | Peer et al. | 434/307 R |
| 2001/0044721 | A1 | 11/2001 | Yoshioka et al. | 704/258 |
| 2003/0024375 | A1 | 2/2003 | Sitrick | 84/477 R |
| 2003/0028273 | A1 | 2/2003 | Lydecker et al. | |
| 2003/0061047 | A1 | 3/2003 | Yoshioka et al. | 704/258 |
| 2003/0220787 | A1 * | 11/2003 | Svensson et al. | 704/207 |
| 2003/0229490 | A1 * | 12/2003 | Etter | 704/211 |
| 2004/0122662 | A1 * | 6/2004 | Crockett | 704/200.1 |
| 2004/0158462 | A1 * | 8/2004 | Rutledge et al. | 704/207 |
| 2004/0167775 | A1 * | 8/2004 | Sorin | 704/208 |
| 2004/0193429 | A1 | 9/2004 | Kimoto | 704/278 |
| 2004/0200337 | A1 | 10/2004 | Abe et al. | 84/616 |
| 2005/0005760 | A1 | 1/2005 | Hull et al. | 84/645 |
| 2005/0047607 | A1 | 3/2005 | Freiheit | |
| 2005/0091045 | A1 * | 4/2005 | Oh | 704/207 |
| 2005/0115382 | A1 | 6/2005 | Jung | 84/616 |
| 2005/0115383 | A1 | 6/2005 | Chang | 84/616 |
| 2005/0149321 | A1 * | 7/2005 | Kabi et al. | 704/207 |
| 2005/0209847 | A1 * | 9/2005 | Singhal et al. | 704/205 |
| 2005/0222847 | A1 * | 10/2005 | Singhal et al. | 704/503 |
| 2005/0244019 | A1 | 11/2005 | Lallemand | 381/94.3 |
| 2006/0021494 | A1 | 2/2006 | Teo et al. | 84/616 |
| 2006/0080088 | A1 * | 4/2006 | Lee et al. | 704/207 |
| 2006/0089833 | A1 * | 4/2006 | Su et al. | 704/230 |
| 2006/0095254 | A1 * | 5/2006 | Walker et al. | 704/207 |
| 2006/0095256 | A1 * | 5/2006 | Nongpiur et al. | 704/207 |
| 2006/0112811 | A1 * | 6/2006 | Padhi et al. | 84/616 |
| 2006/0112812 | A1 | 6/2006 | Venkataraman et al. | 84/616 |
| 2007/0012165 | A1 | 1/2007 | Noh et al. | 84/616 |
| 2007/0106503 | A1 * | 5/2007 | Kim | 704/211 |
| 2007/0127726 | A1 | 6/2007 | Ellis et al. | 381/15 |
| 2007/0154037 | A1 | 7/2007 | Schwartz | |
| 2007/0174048 | A1 * | 7/2007 | Oh et al. | 704/207 |
| 2007/0174049 | A1 * | 7/2007 | Oh et al. | 704/207 |
| 2007/0239437 | A1 * | 10/2007 | Kim | 704/207 |
| 2007/0282602 | A1 * | 12/2007 | Fujishima et al. | 704/207 |
| 2007/0288232 | A1 | 12/2007 | Kim | 704/206 |
| 2007/0299658 | A1 * | 12/2007 | Wang et al. | 704/207 |
| 2008/0033585 | A1 * | 2/2008 | Zopf | 700/94 |
| 2008/0047414 | A1 * | 2/2008 | Friedman et al. | 84/609 |
| 2008/0147384 | A1 * | 6/2008 | Su et al. | 704/207 |
| 2008/0188967 | A1 | 8/2008 | Taub et al. | 700/94 |
| 2008/0232603 | A1 | 9/2008 | Soulodre | |
| 2008/0275695 | A1 * | 11/2008 | Ramo et al. | 704/207 |
| 2009/0222260 | A1 * | 9/2009 | Petr | 704/207 |
| 2009/0222262 | A1 | 9/2009 | Kim et al. | |
| 2009/0225993 | A1 | 9/2009 | Cvetkovic | |
| 2009/0282966 | A1 | 11/2009 | Walker et al. | |
| 2010/0000395 | A1 | 1/2010 | Walker et al. | |
| 2010/0042407 | A1 * | 2/2010 | Crockett | 704/200.1 |
| 2010/0150359 | A1 | 6/2010 | KnicKrehm et al. | |
| 2010/0169085 | A1 * | 7/2010 | Ranga Rao et al. | 704/207 |
| 2010/0198586 | A1 * | 8/2010 | Edler et al. | 704/203 |
| 2010/0211384 | A1 * | 8/2010 | Qi et al. | 704/207 |

FOREIGN PATENT DOCUMENTS

| | | |
|---|---|---|
| JP | 2004-526203 | 8/2004 |

OTHER PUBLICATIONS

Anderson, Eric J., "Limitations of Short-Time Fourier Transforms in Polyphonic Pitch Recognition," University of Washington, Department of Computer Science and Engineering, 74 pages (May 14, 1997).

Bello et al., "An Implementation of Automatic Transcription of Monophonic Music with a Blackboard System," *Proceedings of the Irish Signals and Systems conference*, Dublin, Ireland, 1-4 (Jun. 2000).

Bello et al., "Blackboard System and Top-Down Processing for the Transcription of Simple Polyphonic Music," *Proceedings of the Cost G-6 Conference on Digital Audio Effects*, Verona, Italy, 1-5 (Dec. 7-9, 2000).

Bello et al., "Techniques for Automatic Music Trancription," King's College London, Department of Electronic Engineering, Strand, London, 3 pages (Oct. 23-25, 2000).

Budiansky, Stephen, "Resurrecting Fats," *The Atlantic Monthly*, 285(3): 100-104 (Mar. 2000).

Carreras et al., "Automatic Harmonic Description of Musical Signals Using Schema-Based Chord Decomposition," *Journal of New Music Research*, 28(4): 310-333 (1999).

Cemgil, Ali Taylan, "Automated Monophonic Music Transcription. A Wavelet Theoretical Approach," Bogaziçi University, Computer Engineering, 82 pages (1995).

Chan et al., "Real Time Automated Transcription of Live Music into Sheet Music Using Common Music Notation," 18551: Digital Communication and Signal Processing, Group 9, 23 pages (May 8, 2000).

Dixon, Simon, "Extraction of Musical Performance Parameters from Audio Data," Austrian Research Institute for Artificial Intelligence, Vienna, Austria, 4 pages (Dec. 2000).

Dixon, Simon, "Learning to Detect Onsets of Acoustic Piano Tones," Austrian Research Institute for Artificial Intelligence, Vienna, Austria, 5 pages (Nov. 15-17, 2000).

Dixon, Simon, "On the Computer Recognition of Solo Piano Music," Austrian Research Institute for Artificial Intelligence, Vienna, Austria, 7 pages (Jul. 2000).

Eronen, Antti, "Automatic Musical Instrument Recognition," Tampere University of Technology, Department of Information Technology, 69 pages (Apr. 11, 2001).

Hainsworth et al., "Automatic Bass Line Transcription from Polyphonic Music," University of Cambridge, Department of Engineering, Signal Processing Laboratory, UK, 4 pages (Sep. 22, 2001).

Hainsworth et al., "The Automated Music Transcription Problem," Cambridge University Engineering Department, UK, 23 pages (2004).

Hekland, Fredrik, "Automatic Music Transcription using Autoregressive Frequency Estimation," Norwegian University of Science and Technology, 38 pages (Jun. 14, 2001).

Klapuri et al., "Automatic Transcription of Music," Tampere University of Technology and Nokia Research Center, Tampere, Finland, 7 pages (Oct. 22, 2001).

Kruvczuk et al., "Music Transcription for the Lazy Musician," 18-551 Final Project Report, Group 7, 21 pages (May 8, 2000).

Marolt, Matija, "On Detecting Repeated Notes in Piano Music," University of Ljubljana, Faculty of Computer and Information Science, 2 pages (Oct. 14, 2002).

Marolt, Matija, "SONIC: Transcription of Polyphonic Piano Music with Neural Networks," University of Ljubljana, Faculty of Computer and Information Science, 8 pages (Nov. 15-17, 2001).

Martin, Keith D., "Automatic Transcription of Simple Polyphonic Music: Robust Front End Processing," M.I.T. Media Laboratory Perceptual Computing Section Technical Report No. 399, 1-11 (Dec. 1996).

O'Kane, Jason, "Automated Music Transcription," ias493—Senior Seminar, Taylor University, 14 pages (Jan. 2001).

Pereira, Luis Gustavo, "PCM to MIDI Transposition," Universidade do Porto, Portugal, 96 pages (Sep. 2001).
Plumbley et al., "Automatic Music Transcription and Audio Source Separation," Submitted for publication in *Cybernetics and Systems*, 21 pages (2002).
Raphael, Christopher, "Automatic Transcription of Piano Music," Univ. of Massachusetts, Department of Mathematics and Statistic, Amherst, MA, 5 pages (Oct. 14, 2002).
Slaney et al., "A Perceptual Pitch Detector," *International Conference on Acoustics Speech and Signal Processing*, 357-360 (1990).
Sterian et al., "Music Transcription Systems: From Sound to Symbol," The University of Michigan, Department of Electrical Engineering and Computer Science, Ann Arbor, Michigan, 6 pages (Jul. 30-Aug. 3, 2000).
Tadokoro et al., "A Transcription System Based on Synchronous Addition and Subtraction Processing," Toyohashi University of Technology, Matsue National College of Technology and Toyota National College of Technology, 316-320 (Oct. 7-10, 1996).
International Search Report and Written Opinion of the International Searching Authority for PCT application No. PCT/US2005/034527 mailed on Feb. 20, 2006.
Katayose et al. "Expression Extraction in Virtuoso Music Performances" *Proceedings of the International Conference on Pattern Recognition* vol. 1, pp. 780-784 (1990).
Keren et al. "Automatic Transcription of Polyphonic Music Using the Multiresolution Fourier Transform" IEE 9$^{th}$ *Mediterranean Electrotechnical Conference* vol. 1, pp. 654-657 (1998).
Klapuri "Multiple Fundamental Frequency Estimation Based on Harmonicity and Spectral Smoothness" *IEEE Transactions on Speech and Audio Processing* 11(6): 804-816 (2003).
Muto et al. "Transcription System for Music by Two Instruments" *IEEE 6$^{th}$ Annual International Conference on Signal Processing* vol. 2, pp. 1676-1679 (2002).
Tanaka et al. "Automatic MIDI Data Making from Music WAVE Data Performed by 2 Instruments using Blind Signal Separation" *Proceedings of the 41$^{st}$ Society of Instrument and Control Engineering Annual Conference* vol. 1, pp. 451-456 (2002).
Japanese Office Action for corresponding application No. 2007-538927 mailed May 10, 2011 (No translation).

* cited by examiner

METHODS, SYSTEMS AND COMPUTER PROGRAM PRODUCTS FOR DETECTING MUSICAL NOTES IN AN AUDIO SIGNAL

RELATED APPLICATION(S)

The present application is a continuation of U.S. patent application Ser. No. 10/977,850, filed Oct. 29, 2004 now U.S. Pat. No. 7,598,447, the disclosure of which is hereby incorporated herein by reference in its entireties.

FIELD OF THE INVENTION

The invention relates to data signal processing and, more particularly, to detection of signals of interest in a data signal.

BACKGROUND OF THE INVENTION

It is known in the entertainment industry to use realistic computer graphics (CG) in various aspects of movie production. Many algorithms for natural behavior in the visual domain have been developed for film. For example, algorithms were developed for movies such as Jurassic Park to determine how a natural gait looked, how muscles moved in relation to a skeleton and how light reflected off of skin. However, similar types of problems in the audio, particularly music, domain remain relatively unaddressed. The necessary step is the ability to accurately transcribe what happens in a music performance into precise measurements that allow the fine nuances of the performance to be recreated.

Characterizing music may be a particularly difficult problem. Various approaches have been attempted to providing "automatic transcription" of music, typically from a waveform audio (WAV) format to a Musical Instrument Digital Interface (MIDI) format. Computer musicians generally refer to "WAV-to-MIDI" with reference to transforming a song in digitized waveforms into the corresponding notes in the MIDI format. The source of the recording could be, for example, analog or digital, and the conversion process can start from a record, tape, CD, MP3 file, or the like. Traditional musicians generally refer to such transformation of a song as "Automatic Transcription." Manual transcription techniques are typically used by skilled musicians who listen to recordings repeatedly and carefully copy down on a music score the notes they hear; for example, to notate improvised jazz performances.

Numerous academics have looked at some of the problems in a non-commercial context. In addition, various companies offer software for WAV-to-MIDI decoding, for example, Digital Ear™, intelliScore™, Amazing MIDI, AKoff™, MB TRANS™, and Transcribe!™. These products generally focus on songwriters and amateurs and include capability for determining note pitches and durations, to help musicians create a simple score from a recording. However, these known products tend to be generally unreliable in processing more than one note at a time. In addition, these products generally fail to address the full range of characteristics of music. For example, with a piano, note characteristics may include: pitch, duration, strike and release velocities, key angle, and pedals. Academic research on automatic transcription has also occurred, for example, at the Tampere University of Technology in Finland. Known work on automatic transcription has generally not yielded archival-quality recreation of music performances.

There are 100 years of recordings in the vaults of the recording companies and in private collections. Many great recordings have never been released, because they were marred in some way that made them substandard. Live performances are often commercially not releaseable because of background noises or out-of-tune piano strings. Many analog tapes from previous decades are decaying, because of the chemical formula used in making the tape binder. They also may never have been released because they were recorded on low-quality devices, such as cassette recorders. Similarly, many desirable studio recordings have never seen released, due to instrument or equipment problems during their recording sessions.

The recording industry has embarked on the next set of consumer formats, following CDs in the early 1980's: high-definition surround sound. The new formats include DVD-Audio (DVD-A) and Video and Super Audio CD (SACD). There are 33 million home surround sound systems in use today, a number growing quickly along with high-definition TV. The challenge in the recording industry is bringing older audio material forward into modern sound for re-release. Candidates for such a conversion include mono recordings, especially those before 1955; stereo recordings without multi-channel masters; master tapes from the 1970s and 1980s, which are generally now decaying due to an inferior tape binder formulation; and any of these combined with video captures, which are issued as surround-sound DVDs.

Another music related recording area is creating MIDI from a printed score. For example, like optical character reader (OCR) software for text documents, it is known to provide application software for musicians to allow them to place a music score on a scanner and have music-scan application software convert it into a digitized format based on the scanned image. Similarly, application notation software is known to convert MIDI files to printed musical scores.

Application software for converting from MIDI to WAV is also known. The media player on a personal computer typically plays MIDI files. The better the samples it uses (snippets of digital recordings of acoustic instruments), the better the playback will typically sound. MIDI was originally designed, at least in part, as a way to describe performance details to electronic musical instruments, such as MIDI electronic pianos (with no strings or hammers) available, for example, from Korg, Kurzweil, Roland, and Yamaha.

SUMMARY OF THE INVENTION

Some embodiments of the present invention provide methods, systems and/or computer program products for detection of a note receive an audio signal and generate a plurality of frequency domain representations of the audio signal over time. A time domain representation is generated from the plurality of frequency domain representations. A plurality of edges are detected in the time domain representation and the note is detected by selecting one of the plurality of edges as corresponding to the note based on characteristics of the time domain representation.

In other embodiments of the present invention, methods, systems and/or computer program products for detection of a note receive an audio signal and generate a plurality of sets of frequency domain representations of the audio signal over time, each of the sets being associated with a different pitch. A plurality of candidate notes are identified based on the sets of frequency domain representations, each of the candidate notes being associated with a pitch. Ones of the candidate notes with different pitches having a common associated time of occurrence are grouped and magnitudes associated with the grouped candidate notes are determined. A slope defined by changes in the determined magnitudes with changes in pitch is determined and the note is detected based on the determined slope.

In further embodiments of the present invention, methods for detection of a note include receiving an audio signal. Non-uniform frequency boundaries are defined to provide a plurality of frequency ranges corresponding to different pitches. A plurality of sets of frequency domain representations of the audio data signal over time are generated, each of the sets being associated with one of the different pitches. The note is detected based on the plurality of sets of frequency domain representations.

In yet other embodiments of the present invention, methods, systems and/or computer program products for detection of a signal edge receive a data signal including the signal edge and noise generated edges. The data signal is processed through a first type of edge detector to provide first edge detection data and through a second type of edge detector, different from the first type of edge detector, to provide second edge detection data. One of the edges in the data signal is selected as the signal edge based on the first edge detection data and the second edge detection data. A third edge detector may also be utilized.

In further embodiments of the present invention, methods, systems and/or computer program products for detection of a note receive an audio signal and generate a plurality of frequency domain representations of the audio signal over time. A time domain representation is generated from the plurality of frequency domain representations. A measure of smoothness of the time domain representation is calculated and the note is detected based on the measure of smoothness.

In other embodiments of the present invention, methods, systems and computer program products for detection of a note receive an audio signal and generate a plurality of frequency domain representations of the audio signal over time. A time domain representation is generated from the plurality of frequency domain representations. An output signal is also generated from an edge detector based on the received audio signal. Characterizing parameters associated with the time domain representation are calculated and characterizing parameters associated with the output signal from the edge detector are calculated. The note is detected based on the calculated characterizing parameters of the time domain representation and the output signal from the edge detector.

DETAILED DESCRIPTION OF EMBODIMENTS OF THE INVENTION

Figure 1:
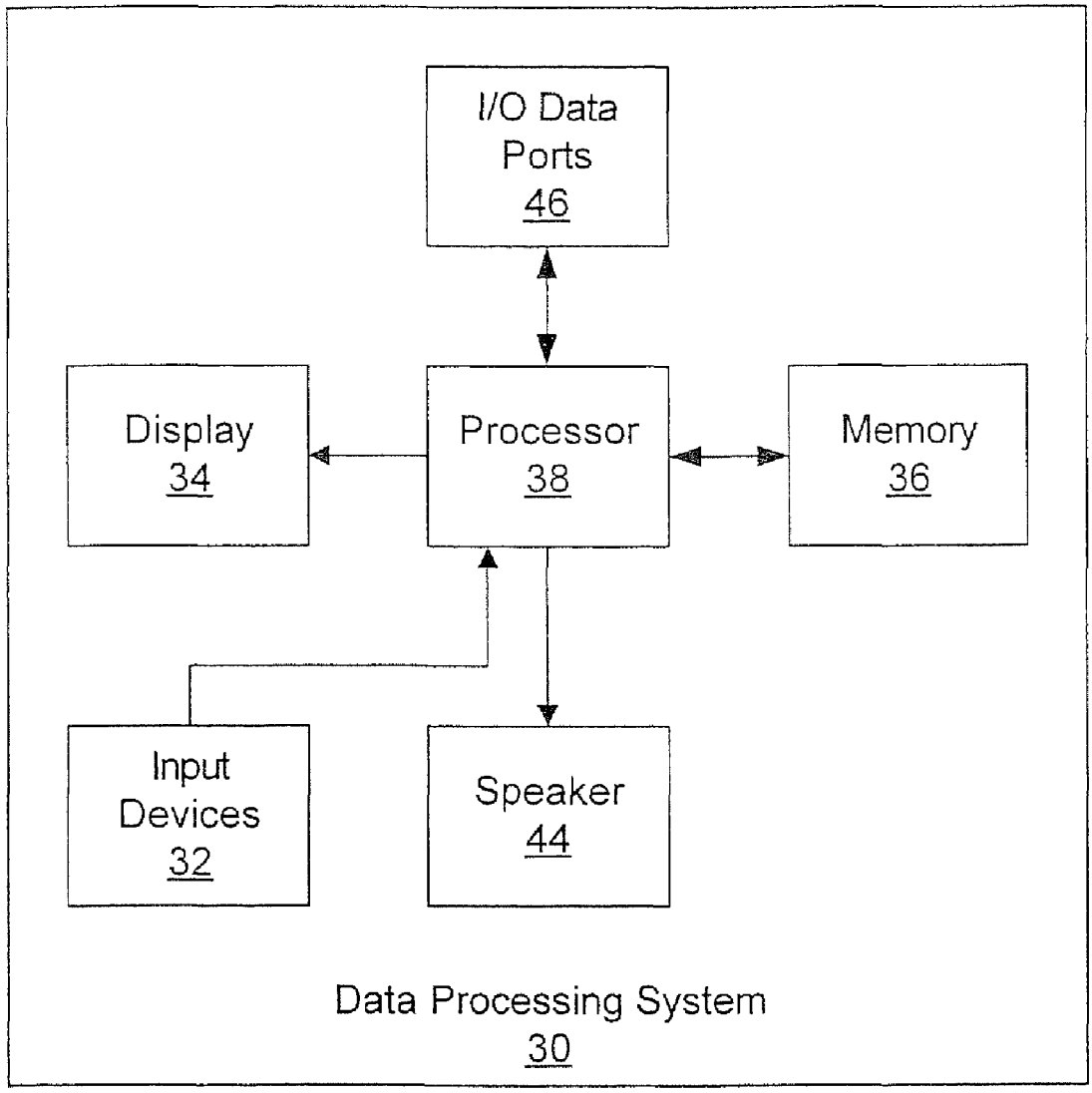
FIG. 1 is a block diagram of an exemplary data processing system suitable for use in embodiments of the present invention.

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will be appreciated by one of skill in the art, the invention may be embodied as methods, data processing systems, and/or computer program products. Accordingly, the present invention may take the form of an entirely hardware embodiment, an entirely software embodiment or an embodiment combining software and hardware aspects, all generally referred to herein as a "circuit" or "module." Furthermore, the present invention may take the form of a computer program product on a computer-usable storage medium having computer-usable program code embodied in the medium. Any suitable computer readable medium may be utilized including hard disks, CD-ROMs, optical storage devices, a transmission media such as those supporting the Internet or an intranet, or magnetic storage devices.

Computer program code for carrying out operations of the present invention may be written in an object oriented programming language such as JAVA7, Smalltalk or C++. However, the computer program code for carrying out operations of the present invention may also be written in conventional procedural programming languages, such as the "C" programming language or in a visually oriented programming environment, such as VisualBasic. Dynamic scripting languages such as PHP, Python, XUL, etc. may also be used. It is also possible to use combinations of programming languages to provide computer program code for carrying out the operations of the present invention.

The program code may execute entirely on the user's computer, partly on the user's computer, as a stand-alone software package, partly on the user's computer and partly on a remote computer or entirely on the remote computer. In the latter scenario, the remote computer may be connected to the user's computer through a local area network (LAN) or a wide area network (WAN), or the connection may be made to an external computer (for example, through the Internet using an Internet Service Provider).

The invention is described in part below with reference to flowchart illustrations and/or block diagrams of methods, systems and/or computer program products according to some embodiments of the invention. It will be understood that each block of the illustrations, and combinations of blocks, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the block or blocks.

These computer program instructions Nay also be stored in a computer-readable memory that can direct a computer or other programmable data processing apparatus to function in a particular manner, such that the instructions stored in the computer-readable memory produce an article of manufacture including instruction means which implement the function/act specified in the block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

Embodiments of the present invention will now be discussed with reference to FIGS. 1 through 13. As described herein, some embodiments of the present invention provide methods systems and computer program products for detecting edges. Furthermore, particular embodiments of the present invention provide for detection of notes and may be used, for example, in connection with automatic transcription of musical scores to a digital format, such as MIDI. Manipulation and reproduction of such performances may be enhanced by conversion to a note based digital format, such as the MIDI format.

Using computer technology, detection of notes according to various embodiments of the present invention may change how music is created, analyzed, and preserved by advancing audio technology in ways that may provide highly realistic reproduction and increased interactivity. For example, some embodiments of the present invention may provide a capability analogous to optical character recognition (OCR) for piano recordings. In such embodiments, piano recordings may be converted back into the keystrokes and pedal motions that would have been used to create them. This may be done, for example, in a high-resolution MIDI format, which may be played back with high reality on corresponding computer-controlled grand pianos.

In other words, some embodiments of the present invention may allow decoding of recordings back into a format that can be readily manipulated. Doing so may benefit the music industry by unlocking the asset value in historical recording vaults. Such recordings may be regenerated into new performances, which can play afresh on in-tune concert grand pianos in superior halls. The major music labels could thereby re-record their works in modern sound. The music labels could use a variety of recording formats, such as today's high-definition surround-sound Super Audio CD (SACD) or DVD-Audio (DVD-A), and re-release recordings from back catalog. The music labels could also choose to use the latest digital rights management in the re-release.

Referring now to FIG. 1, a block diagram of data processing systems suitable for use in systems according to some embodiments of the present invention will be discussed. As illustrated in FIG. 1, an exemplary embodiment of a data processing system 30 may include input device(s) 32 such as a microphone, keyboard or keypad, a display 34, and a memory 36 that communicate with a processor 38. The data processing system 30 may further include a speaker 44, and an I/O data port(s) 46 that also communicate with the processor 38. The I/O data ports 46 can be used to transfer information between the data processing system 30 and another computer system or a network. These components may be conventional components, such as those used in many conventional data processing systems, which may be configured to operate as described herein.

Figure 2:
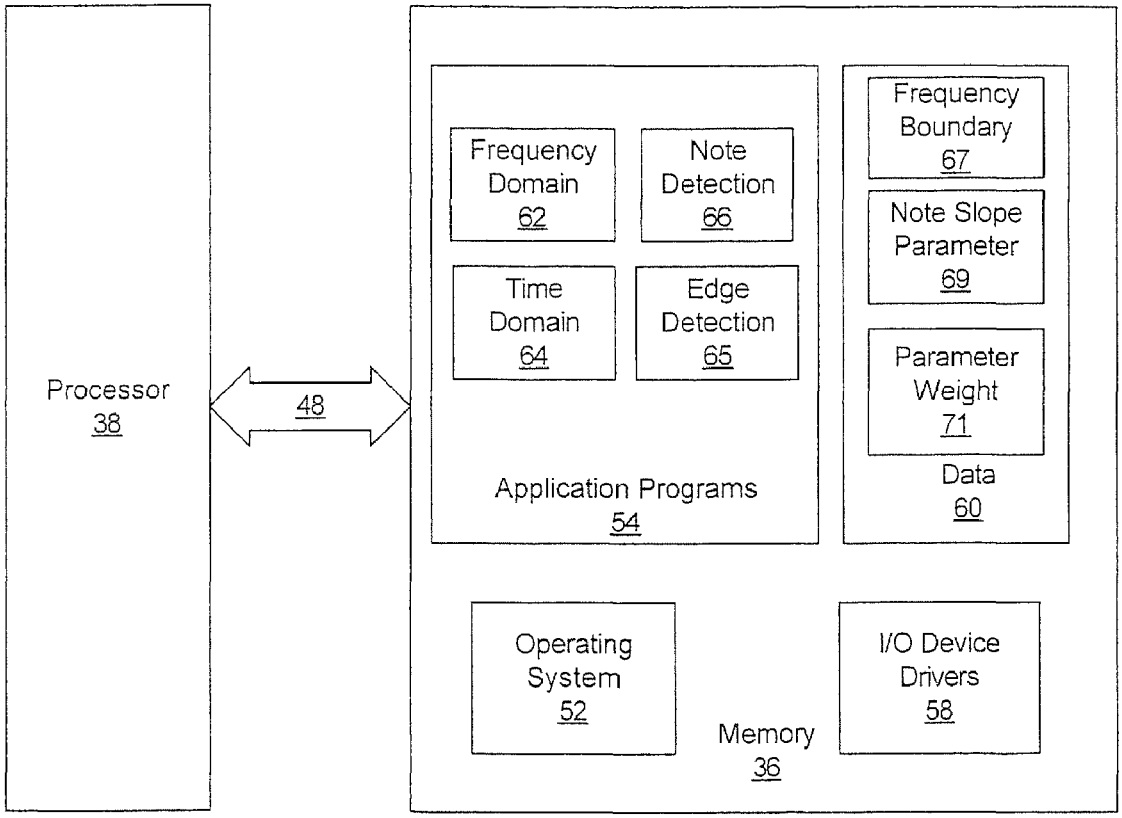
FIG. 2 is a more detailed block diagram of an exemplary data processing system incorporating some embodiments of the present invention.

FIG. 2 is a block diagram of data processing systems that illustrates systems, methods, and/or computer program products in accordance with some embodiments of the present invention. The processor 38 communicates with the memory 36 via an address/data bus 48. The processor 38 can be any commercially available or custom processor, such as a microprocessor. The memory 36 is representative of the overall hierarchy of memory devices containing the software and data used to implement the functionality of the data processing system 30. The memory 36 can include, but is not limited to, the following types of devices: cache, ROM, PROM, EPROM, EEPROM, flash memory, SRAM and/or DRAM.

As shown in FIG. 2, the memory 36 may include several categories of software and data used in the data processing system 30: the operating system 52; the application programs 54; the input/output (I/O) device drivers 58; and the data 60. As will be appreciated by those of skill in the art, the operating system 52 may be any operating system suitable for use with a data processing system, such as OS/2, AIX or System390 from International Business Machines Corporation, Armonk, N.Y., Windows95, Windows98, Windows2000 or WindowsXP from Microsoft Corporation, Redmond, Wash., Unix, Linux, Sun Solaris or Apple Macintosh OS X. The I/O device drivers 58 typically include software routines accessed through the operating system 52 by the application programs 54 to communicate with devices, such as the I/O data port(s) 46 and certain memory 36 components. The application programs 54 are illustrative of the programs that implement the various features of the data processing system 30. Finally, the data 60 represents the static and dynamic data used by the application programs 54, the operating system 52, the I/O device drivers 58, and other software programs that may reside in the memory 36.

As is further seen in FIG. 2, the application programs 54 may include a frequency domain module 62, a time domain module 64, an edge detection module 65 and a note detection module 66. The frequency domain module 62, in some embodiments of the present invention, generates a plurality of sets of frequency domain representations, using, but not limited to, such transforms as fast fourier transforms (FFT, DFT, DTFT, STFT, etc.), wavelet based transforms (wavelets, wavelet packets, etc.), and/or using, but not limited to, such spectral estimation techniques as linear least squares, nonlinear least squares, High-Order Yule-Walker, Pisarenko, MUSIC, ESPRIT, Min-Norm, and the like or other representations of an audio signal over time. Each set may be associated with a particular frequency taken at different times. The time domain module 64 may generate a time domain representation from each set of frequency domain representations (i.e., a plot of the FFT data for a particular frequency over time). The edge detection module 65 may detect a plurality of edges in the time domain representation(s) from the time domain module 64. Finally the note detection module 66 detects the note by selecting one of the edges as corresponding to the note based on the characteristics of the time domain representation(s). Operations of the various application modules will be further described with reference to the embodiments illustrated in the flowchart diagrams of FIGS. 3-13.

The data portion 60 of memory 36, as shown in the embodiments illustrated in FIG. 2, may include frequency boundaries data 67, note slope parameter data 69 and parameter weight data 71. The frequency boundaries data 67 may be used to provide non-uniform frequency boundaries for generating frequency domain representations by the frequency domain module 62. The note slope parameter data 69 may be utilized by the edge detection module 65 in edge detection as will be described further herein. Finally the parameter weight data 71 may be used by the note detection module 66 to determine which edges from the edge detection module 65 correspond to notes.

While embodiments of the present invention have been illustrated in FIG. 2 with reference to a particular division between application programs, data and the like, the present invention should not be construed as limited to the configuration of FIG. 2, as the invention encompasses any configuration capable of carrying out the operations described herein. For example, while the edge detection 64 and note detection 66 are illustrated as separate applications, the functionality provided by the applications could be provided in a single application or in more than two applications.

Various of the known approaches to automatic transcription of music discussed above process an audio signal though digital signal processing (DSP) operations, such as Laplace transforms, Fast Fourier transforms (FFTs), discrete Fourier transforms (DFTs) or short time Fourier transforms (STFTs). Alternative approaches to this initial processing may include gamma tone filters, band pass filters and the like. The frequency domain information from the DSP is then provided to a note identification process, typically a neural network that has been trained based on some form of known input audio signal.

In contrast, some embodiments of the present invention, as will be described herein process the frequency domain data through edge detection with the edge detection module 65 and then carry out note detection with the note detection module 66 based on the detected edges. In other words, a plurality of edges are detected in a time domain representation generated for a particular pitch from the frequency domain information. It will be understood that the time domain representation corresponds to a set of frequency domain representations for a particular pitch over time, with a resolution for the time domain representation being dependent on a resolution window used in generating the frequency domain representations, such as FFTs. In other words, a rising edge corresponds to energy appearing at a particular frequency band (pitch) at a particular time.

Note detection then processes the detected edges to distinguish a musical note (i.e., a fundamental) from harmonics, bleeds and/or noise signals from other sources. Further information about a detected note may be determined from the time domain representation in addition to a start time associated with a time of detection of the edge found to correspond to a musical note. For example, a maximum amplitude and duration may be determined for the detected note, which characteristics may further characterize the performance of the note, such as, for a piano key stroke, a strike velocity, duration and/or release velocity. The pitch may be identified based on the frequency band of the frequency domain representations used to build the time domain representation including the detected note.

As will be further described herein, while various techniques are known for edge detection that are suitable for use with embodiments of the present invention, some embodiments of the present invention utilize novel approaches to edge detection, such as processing the time domain representations through multiple edge detectors of different types. One of the edge detectors may be treated as the primary source for identifying the presence of edges in the time domain representation, while the others may be utilized for verification and/or as hints indicating that a detected edge from the primary edge detector is more likely to correspond to a musical note, which information may be used during subsequent note detection operations. An example of a configuration utilizing three edge detectors will now be described.

It will be understood that an edge detector, as used are herein, refers to a shape detector that may be set to detect a sharp rise associated with an edge being present in the data. In some cases the edges may not be readily detected (such as a repeated note, where a second note may have a much smaller rise) and edge detection may be based on detection of other shapes, such as a cap at the top of the peak for the repeated note.

The first or primary edge detector for this example is a conventional edge detector that may be tuned to a rising edge slope generally corresponding to that expected for a typical note occurring over a two octave musical range. However, as each pitch corresponds to a different time domain representation being processed through edge detection, the edge detector may be tuned to an expected slope for a note of a particular pitch corresponding to a time domain representation being processed, and then re-tuned for other time domain representations. As automatic transcription of music may not be time sensitive, a common edge detector may be used that is re-calibrated rather than providing a plurality of separately tuned primary edge detectors for concurrent processing of different pitches. The edge detector may also be tuned to select a start time for a detected rising edge based on a point intermediate to the detected start and peak time, which may reduce variability in the start time detection.

It will also be understood that the sample period for generating the frequency domain representations may be decreased to increase the time resolution of the corresponding time domain representations generated therefrom. For example, while the present inventors have successfully utilized ten millisecond resolution, it may be desirable, in some instances, to increase resolution to one millisecond to provide even more accurate identification of start time for a detected musical note. However, it will be understood that doing so will increase the amount of data processing required in generation of the frequency domain representations.

Continuing with this example of a multiple edge detector embodiment of the present invention, the second edge detector may be a detector responsive to a shape of, rather than energy in, an edge. In other words, normalization of the input signal may be provided to increase the sensitivity for detection of a particular shape of rising edge in contrast with an even greater energy level of a "louder" edge having a different shape. For this particular example, a third edge detector is also used to provide "hints" (i.e., verification of edges detected by the first edge detector). The third edge detector may be configured to be an energy responsive edge detector, like the primary edge detector, but to require more energy to detect an edge. For example, the first edge detector may have an analysis window over ten data points, each of ten milliseconds (for a total of 100 milliseconds), while the third edge detector may have an analysis window of thirty data points (for a total of 300 milliseconds).

The particular length of the longer time analysis window may be selected, for example, based on characteristics of an instrument generating the notes being detected. A piano, for example, typically has a note duration of at least about 150 milliseconds so that a piano note would be expected to last longer than the analysis window of the first edge detector and, thus, provide additional energy when analyzed by the third edge detector, while a noise pulse in the time signal may not provide any additional energy by extension of the analysis window.

As will be described further herein, once an edge is detected, a plurality of characterizing parameters of the time domain representation in which the edge was detected may be generated for uses in detecting a note in various embodiments of the present invention. Particular examples of such characterizing parameters will be provided after describing various embodiments of the present invention with reference to the flow chart illustrations in the figures.

Figure 3:
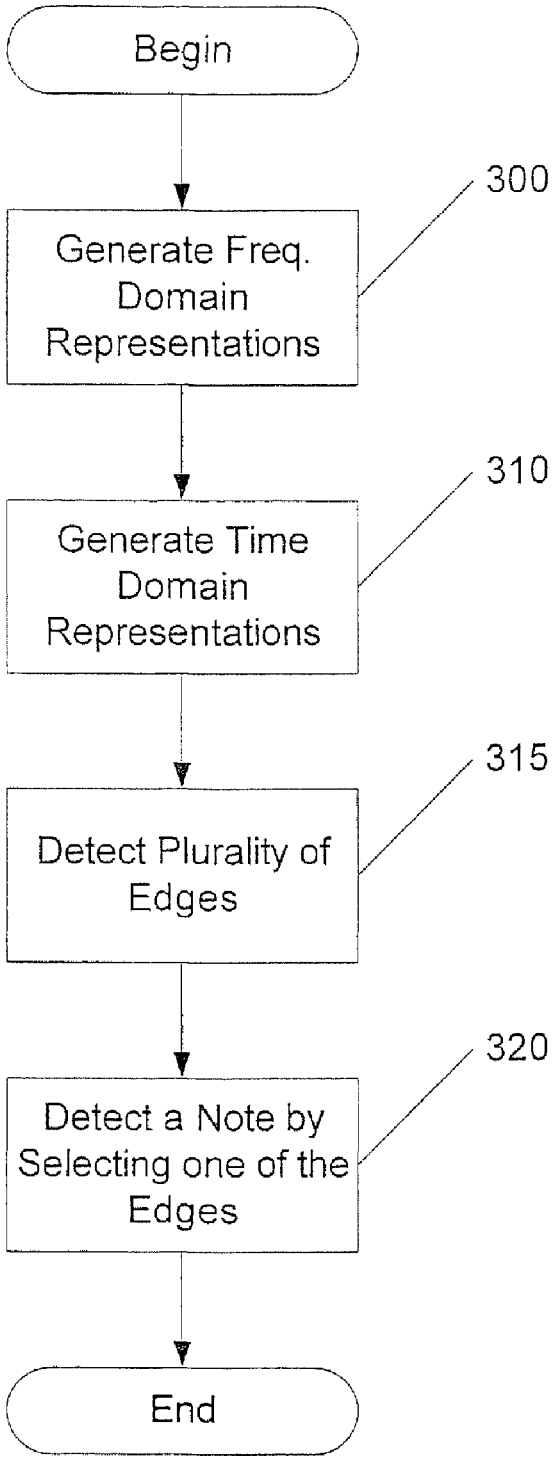
FIGS. 3 to 5 are flow charts illustrating operations for detecting a note according to various embodiments of the present invention.

FIG. 3 illustrates operations for detecting a note according to some embodiments of the present invention that may be carried out, for example, by the application programs 54. As seen in the embodiments of FIG. 3, operations begin at Block 300 by generating a plurality of frequency domain representations of an audio signal over time. Time domain representation(s) are generated from the plurality of frequency domain representations (Block 310). The time domain representations may be the frequency domain information from Block 310 for a given frequency band (pitch) plotted over time, with a resolution determined by the resolution used for sampling in generating an FFT, or the like, to provide the frequency domain representations. A plurality of edges are detected in the time domain representation(s) (Block 315). The note is detected by selecting one of the plurality of edges as corresponding to the note based on characteristics of the time domain representation(s) generated in Block 310.

It will be understood that, while the present invention encompasses detection of a single note in a single time domain representation generated from a plurality of frequency domain representations over time, automatic transcription of the music will typically involve capturing a plurality of different notes having different pitches. Thus, operations at Block 300 may involve generating a plurality of sets of frequency domain representations of the audio signal over time wherein each of the sets is associated with a different pitch. Furthermore, operations at Block 310 may include generating a plurality of time domain representations from the respective sets of frequency domain representations, each of the time domain representations being associated with one of the different pitches. A plurality of edges may be detected at Block 315 in one or more of the time domain representations associated with different notes, bleeds or harmonics of notes.

Operations for detecting a note at Block 320 may include determining a duration of the note. The duration may be associated with the mechanical action generating the note. For example, the mechanical action may be a keystroke on a piano.

As discussed above for the embodiments of FIG. 3, frequency domain data may be generated for a plurality of frequencies, which may correspond to particular musical pitches. In some embodiments of the present invention, generating the frequency domain data may further include automatic pitch tracking. For musical instruments, there is typically a primary (fundamental) frequency that is generated when a note is played. This primary frequency is generally accompanied by harmonics. When instruments are in tune, the frequency that corresponds to each note/pitch is typically defined by a predetermined set of scales. However, due to a number of factors, this primary frequency (and, thus, the harmonics as well) may diverge from the expected frequency (e.g., the note on the instrument goes out of tune). Thus, it may be desirable to provide for pitch tracking during processing to adjust to notes going out of tune.

In some embodiments of the present invention, pitch tracking may be provided using frequency tracking algorithms (e.g., phase locked loops, equalization algorithms, etc.) to track notes that go out of tune. One processing module may be provided for the primary frequency and each harmonic. In the case of multiple instances of the frequency producer (e.g., multiple strings used on a piano or different strings on a guitar), multiple processing modules may be provided for the primary frequency and for each corresponding harmonic. Communication is provided between each of the tracking entities because, as the primary frequency changes, a corresponding change typically needs to be incorporated in each of the related harmonic tracking processing modules.

Pitch tracking could be implemented and applied to the raw data (a priori) or could be run in parallel for during processing adaptation. Alternatively, the pitch tracking process could be applied a posteriori, once it has been determined that notes are missing from an initial transcription pass. The pitch tracking process could then be applied only for notes where there are losses due to being out of tune. In other embodiments of the present invention, manual corrections could also be applied to compensate for frequency drift problems (manual pitch tracking) as an alternative to the automated pitch tracking described herein.

Figure 4:
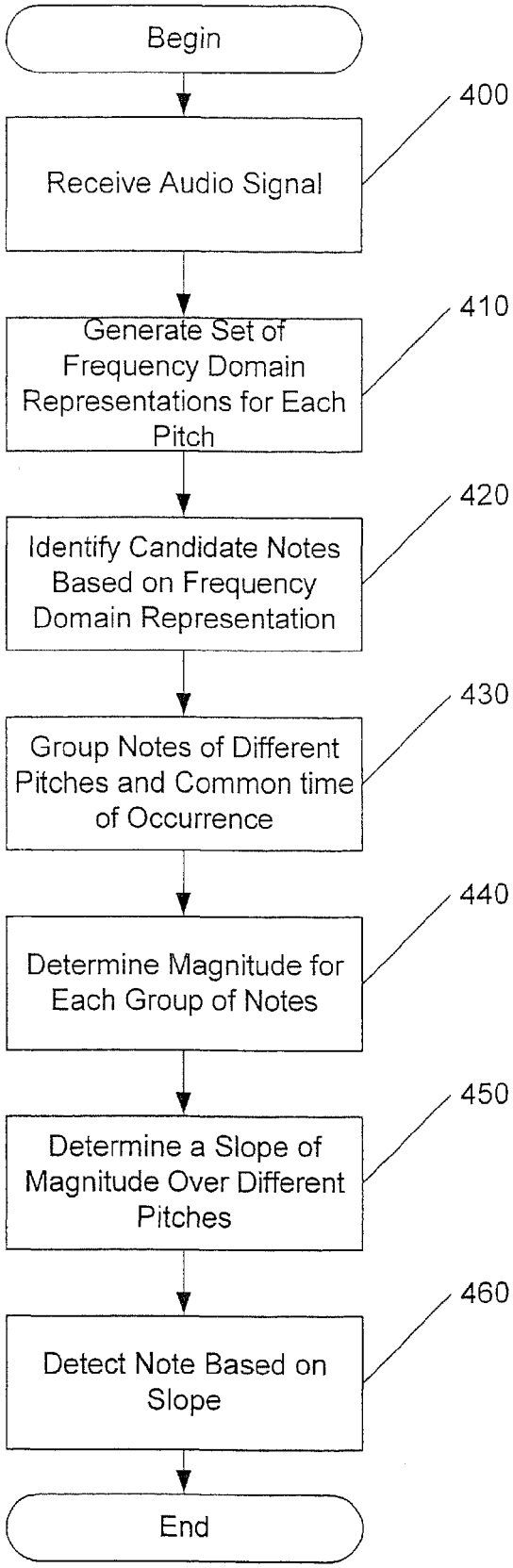

Further embodiments of the present invention for detection of a note will now be described with reference to the flowchart illustration of FIG. 4. Operations begin for the embodiments of FIG. 4 with receiving an audio signal (Block 400). A plurality of sets of frequency domain representations of the audio signal over time are generated (Block 410). Each of the sets of frequency domain representations are associated with a different pitch. A plurality of candidate notes are identified based on the sets of frequency domain representations (Block 420). Each of the candidate notes is associated with a pitch.

Ones of the candidate notes with different pitches having a common associated time of occurrence are grouped (Block 430). Magnitudes associated with a group of candidate notes are determined (Block 440). A slope defined by changes in the determined magnitude with changes in pitch is then determined (Block 450). The note is then detected based on the determined slope (Block 460). Thus, for the embodiments illustrated in FIG. 4, a relative magnitude relationship between a peak magnitude for a fundamental note and its harmonics may be used to distinguish the presence of a note in an audio signal, as contrasted with noise, harmonics, bleeds and the like.

It will be understood that, in other embodiments of the present invention, a relationship between a harmonic and a fundamental note may be utilized in note detection without generating slope information as described with reference to FIG. 4. Thus, where a plurality of edges are detected in two or more distinct time domain representations, detecting a note may include identifying one of the edges in a first one of the time domain representations as corresponding to a fundamental of the note and identifying one of the edges in a different one of the time domain representations as corresponding to a harmonic of the note. Thus, distinguishing a harmonic from a fundamental need not include comparison of magnitude changes with increasing pitch across a range of harmonics.

Figure 5:
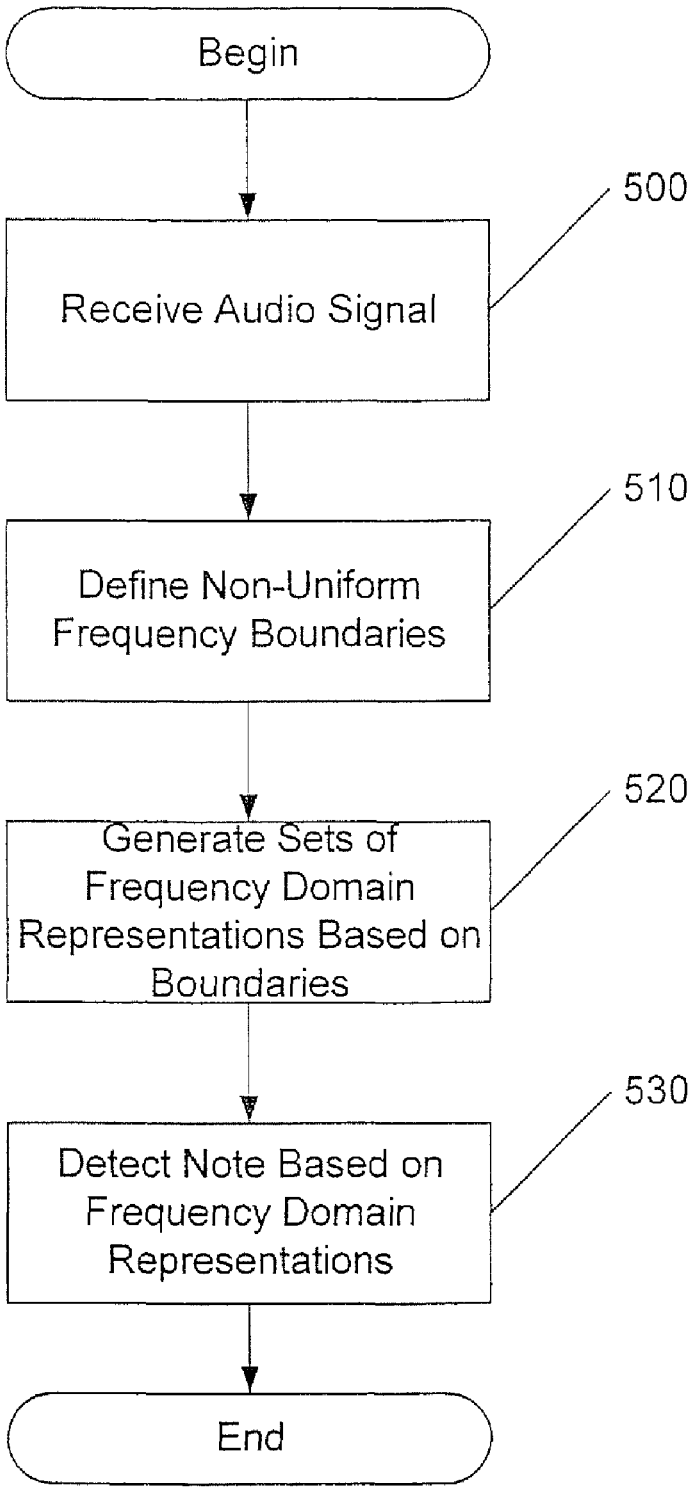

Operations for detection of a note according to further embodiments of the present invention will now be described with reference to the flowchart illustration of FIG. 5. As shown for the embodiments of FIG. 5, operations begin at Block 500 by receiving an audio signal. Non-uniform frequency boundaries are defined to provide a plurality of frequency ranges corresponding to different pitches (Block 510). Such non-uniform frequency boundaries may be stored, for example, in the frequency boundaries data 67 (FIG. 2).

A plurality of sets of frequency domain representations of the audio signal are generated over time (Block 520). Each of the sets is associated with one of the different pitches. The note is then detected based on the plurality of sets of frequency domain representations (Block 530).

Operations for defining non-uniform frequency boundaries at Block 510 may include defining the non-uniform frequency boundaries to provide a substantially uniform resolution for each of a plurality of pre-defined pitches corresponding to musical notes. Non-uniform frequency boundaries may also be provided so as to provide a frequency range for each of a plurality of pre-defined pitches corresponding to harmonics of the musical notes.

The non-uniform frequency boundaries described with reference to FIG. 5 may also be utilized with the embodiments described above with reference to FIGS. 3 and 4. Thus, non-uniform frequency boundaries may be defined to provide a frequency range associated with each set of frequency domain representations corresponding to a different pitch. A substantially uniform resolution may be provided for each of a plurality of pre-defined pitches corresponding to musical notes by selection of the non-uniform frequency boundaries.

Operations for detection of a signal edge according to various embodiments of the present invention will now be described with reference to a flowchart illustration of FIG. 6. Operations begin at Block 600 with receipt of a data signal including the signal edge and noise generated edges. The data signal is process through a first type of edge detector to provide first edge detection data (Block 610). In particular embodiments of the present invention, the first type of edge detector is responsive to an energy level of an edge in the data signal and may be tuned to a slope characteristic of the signal edge. For example, note slope parameters for a note associated with a particular pitch may be stored in the note slope parameter data 69 (FIG. 2) and used to calibrate the first edge detector. The first type of edge detector may be tuned to a common slope characteristic representative of different types of signal edges or tuned to a plurality of slope characteristics, each of which is representative of a different type of signal edge, such as a signal edge associated with a musical different note.

The data signal representation is further processed through a second type of edge detector different from the first type of edge detector to provide different edge protection data (Block 620). For example, the second of type of edge detector may be normalized so as to be responsive to a shape of an edge detected in the data signal.

In addition to the first and second edge detectors, as illustrated at Block 630, for some embodiments of the present invention, the data signal is further processed through a third edge detector. The third edge detector may be the same type of edge detector as the first edge detector but have a longer time analysis window. A longer time analysis window for the third edge detection may be selected to be at least as long as a characteristic duration associated with the signal edge. For example, when a signal edge corresponds to an edge expected to be generated by strike of a piano key, mechanical characteristics of the key may limit the range of durations expected from a note struck by the key. As such, the third edge detector may detect an edge based on a higher energy level threshold than the first type of edge detector. Thus, in some embodiments of the present invention, a third set of edge detection data is provided in addition to the first and second edge detection data.

One of the edges in the data signal is selected as the signal edge based on the first edge detection data, the second edge detection data and/or the third edge detection data (Block 640). In particular embodiments of the present invention, operations at Block 640 include increasing the likelihood that an edge corresponds to the signal edge based on a correspondence between an edge detected in the first edge detection data and an edge detected in the second edge detection data and/or the third edge detection data. For an instrument, such as a piano, the longer time analysis window for the third edge detector may be about 300 milliseconds.

It will be understood that the signal edge detection operations described with reference to FIG. 6 may be applied to detection of a musical note as described previously with reference to other embodiments of the present invention. Thus, the first type of edge detector may be tuned to a slope characteristic of a musical note and the second type of edge detector may be normalized to be responsive to the shape of an edge formed by a musical note in one of the time domain representations. The first type of edge detector may be tuned to a slope characteristic representative of a range of musical notes and a common slope characteristic may be used in edge detection or tuned to a plurality of slope characteristics each of which is representative of a different musical note. In particular embodiments of the present invention when associating a start time with a detection of a note, the start time may be selected as corresponding to a point intermediate the start and the peak of the detected edge associated with the note rather than the start or peak point itself.

Figure 7:
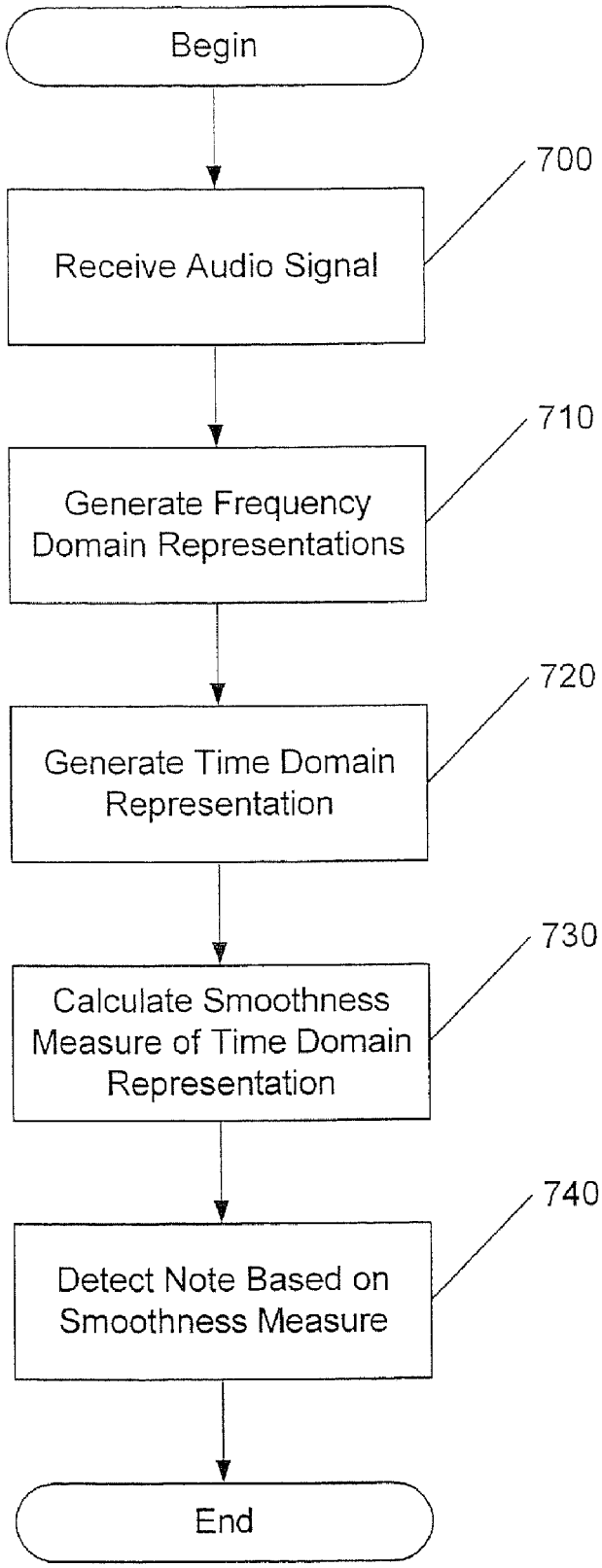
FIG. 7 is a flow chart illustrating operations for detecting a note according to some embodiments of the present invention.

Operations for detection of a note will now be described for further embodiments of the present invention with reference to the flowchart illustration of FIG. 7. For the embodiments illustrated in FIG. 7, operations begin at Block 700 by receiving an audio signal. A plurality of frequency domain representations of the audio signal over time are generated (Block 710). A time domain representation is generated from the plurality of frequency domain representations (Block 720). A measure of smoothness of the time domain representation is then calculated (Block 730). The note may then be detected based on the measure of smoothness (Block 740). The present inventors have discovered that the smoothness characteristics of the signal in the time domain representation may be a particularly effective characterizing parameter for distinguishing between noise signals and musical notes. Various particular embodiments of methods for generating a measure of smoothness of such a curve in the time domain representation will now be described with reference to FIG. 8.

Figure 8:
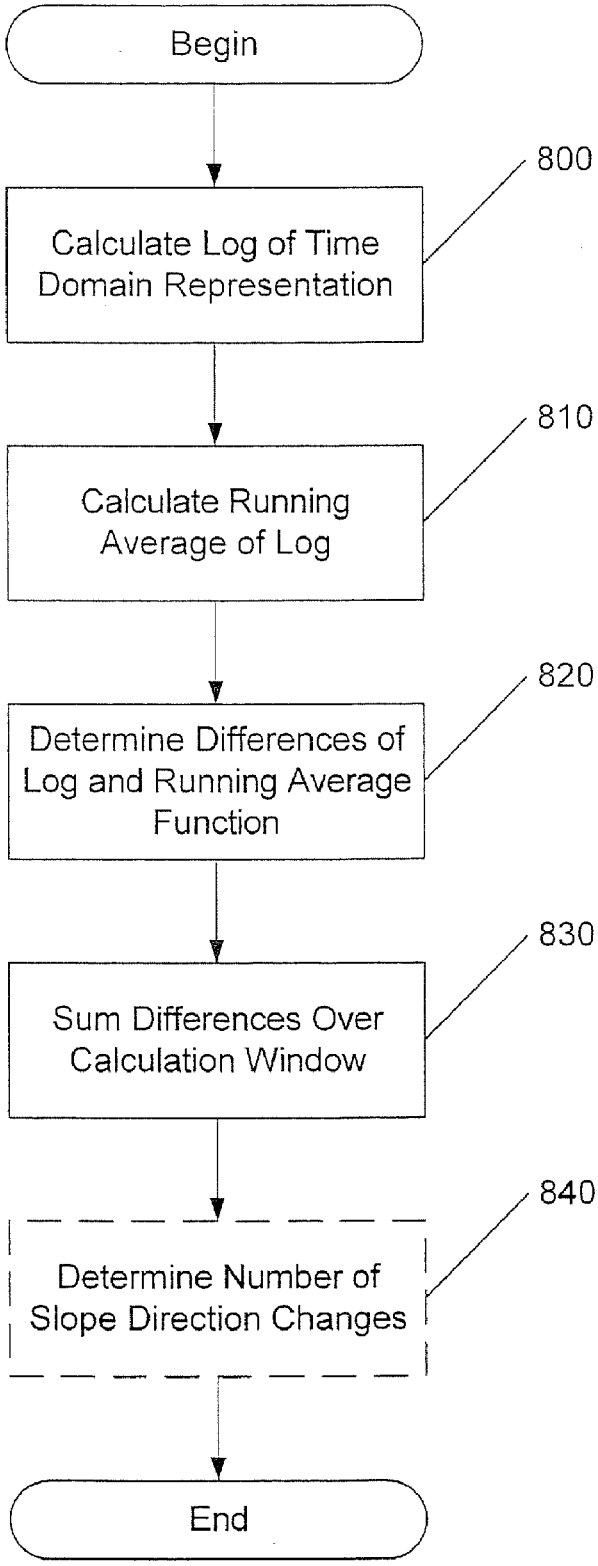
FIG. 8 is a flow chart illustrating operations for measuring smoothness according to some embodiments of the present invention.

As shown in the illustrated embodiments of FIG. 8, operations begin at Block 800 by calculating a logarithm, such as a natural log, of the time domain representation. A running average function of the natural log of the time domain representation is then calculated (Block 810). The calculated natural log from Block 800 and the running average function from Block 810 may then be compared to provide the measure of smoothness. For example, for the particular embodiments illustrated in FIG. 8, the comparing operations include determining the differences between the natural log and the running average function at respective points in time (Block 820). The determined differences are then summed over a calculation window to provide the measure of smoothness (Block 830). For example, the audio signal may be processed using FFTs that are arranged in a time sequence to provide a time domain representation of the FFT data:

$$F_{raw}(t)=S(t)+N(t)$$

where $F_{raw}(t)$ is the time domain representation of the FFT data, S(t) is the signal and N(t) is noise. A logarithm, such as a natural log, is taken as follows:

$$F_{ln}(t_i)=\ln(F_{raw}(t_i))$$

An average function is generated of the natural log as follows:

$$F_{final}(t_i)=(F_{ln}(t_{i-1})+F_{ln}(t_i)+F_{ln}(t_{i+1}))/3$$

Finally, a measure of smoothness function (var10d) is generated as a ten point average of the difference between the average function and the natural log. For this particular example of a measure of smoothness, a smaller value indicates a smoother shape to the curve.

As illustrated at Block 840, other methods may be utilized to identify a measure of smoothness. For example, for the operations illustrated at Block 840, a measure of smoothness may be determined by determining a number of slope direction changes in the natural log in a count time window around an identified peak in the natural log.

Figure 9:
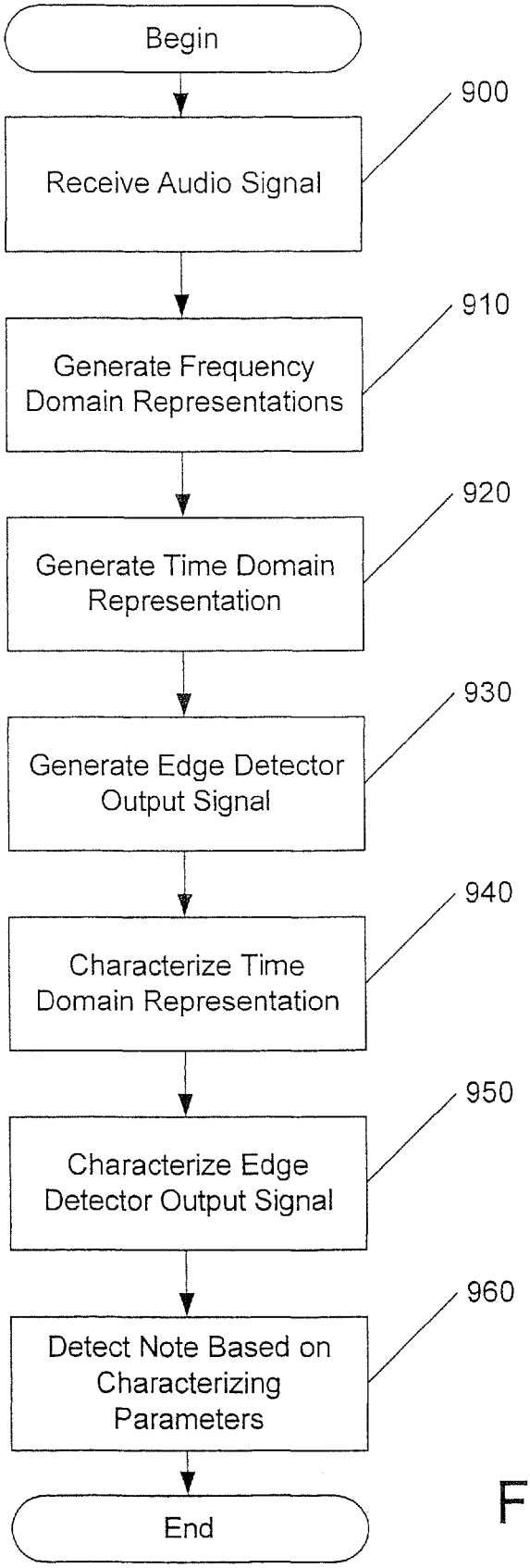
FIGS. 9 to 13 are flow charts illustrating operations for detecting a note according to further embodiments of the present invention.

Operations for detection of a note according to yet further embodiments of the present invention will now be described with reference to FIG. 9. As shown in FIG. 9, operations begin at Block 900 by receiving an audio signal. A plurality of frequency domain representations of the audio signal are generated over time (Block 910). A time domain representation is then generated from the plurality of frequency domain representation (Block 920). The audio signal is also processed through an edge detector and an output signal from the edge detector is generated based on the received audio signal (Block 930).

Characterizing parameters are calculated associated with the time domain representation (Block 940). As noted above, characterizing parameters may be computed for each edge detected by the first edge detector, or for each edge meeting a minimum amplitude threshold criterion for the output signal from the edge detector. Characterizing parameters may be generated for the time domain representation and may also be generated for the output signal from the edge detector in some embodiments of the present invention as will be described below. An example set of suitable characterizing parameters will now be described for a particular embodiment of the present invention. For this particular embodiment, the characterizing parameters based on the time domain representation include a maximum amplitude, a duration and wave shape properties. The wave shape properties include a leading edge shape, a first derivative and a drop (i.e., at a fixed time past the peak amplitude how far has the amplitude decayed). Other parameters include a time to the peak amplitude, a measure of smoothness, a runlength of the measure of smoothness (i.e. a number of smoothness points in a row below a threshold criterion (either allowing no or a limited number of exceptions), a run length of the measure of smoothness in each direction starting at the peak amplitude, a relative peak amplitude from a declared minimum to a declared maximum and/or a direction change count for an interval before and after the peak amplitude in the measure of smoothness.

Different characterizing parameters may be provided in other embodiments of the present invention. For example, in some embodiments of the present invention, the characterizing parameters associated with a time domain representations include at least one of: a run length of the measure of smoothness satisfying a threshold criterion; a peak run length of the measure of smoothness satisfying a threshold criterion starting at a peak point corresponding to a maximum magnitude of the one of the time domain representations; a maximum magnitude; a duration; wave shape properties; a time associated with the maximum magnitude; and/or a relative magnitude from a determined minimum peak time magnitude value to a determined maximum peak time magnitude value.

Characterizing parameters associated with the output signal from the edge detector are also calculated for the embodiments of FIG. 9 (Block 950). The characterizing parameters for the output of the edge detector may include the time of occurrence as well as a peak amplitude, an amplitude at first and second offset times from the peak and/or a maximum run length. These parameters may be used, for example, where a double peak signal occurs in a very short window to discard the lower magnitude one of the peaks as a distinct edge indication. Characterizing parameters may also be generated based on the output signals from the second or third edge detector. For example, it has been found by the inventors that a wider output signal pulse from the second or third edge detector tends to correlate with a greater likelihood that a detected edge corresponds to a musical note. In other embodiments of the present invention, the characterizing parameters associated with an edge detection signal corresponding to a time domain representation including the edge include at least one of a maximum magnitude, a magnitude at a first predetermined time offset in each direction from the maximum magnitude time, a magnitude at a second predetermined time offset, different from the first predetermined time offset, in each direction from the maximum magnitude time and/or a width of the edge detection signal from a peak magnitude point in each direction without a change in slope direction.

The note is then detected based on the calculated characterizing parameters of the time domain representation and of the output signal from the edge detector (Block 960). Thus, for the particular embodiments illustrated in FIG. 9, the edge detector signal characteristics are utilized not only for detection of edges but also in the decision process related to detection of the note. It will be understood, however, that for other embodiments of the present invention, a note may be detected based solely on the time domain representation generated from the frequency domain representations of the perceived audio signal and the edge detector output signal may be used solely for the purposes of identifying edges to be evaluated in the note detection process.

Figure 10:
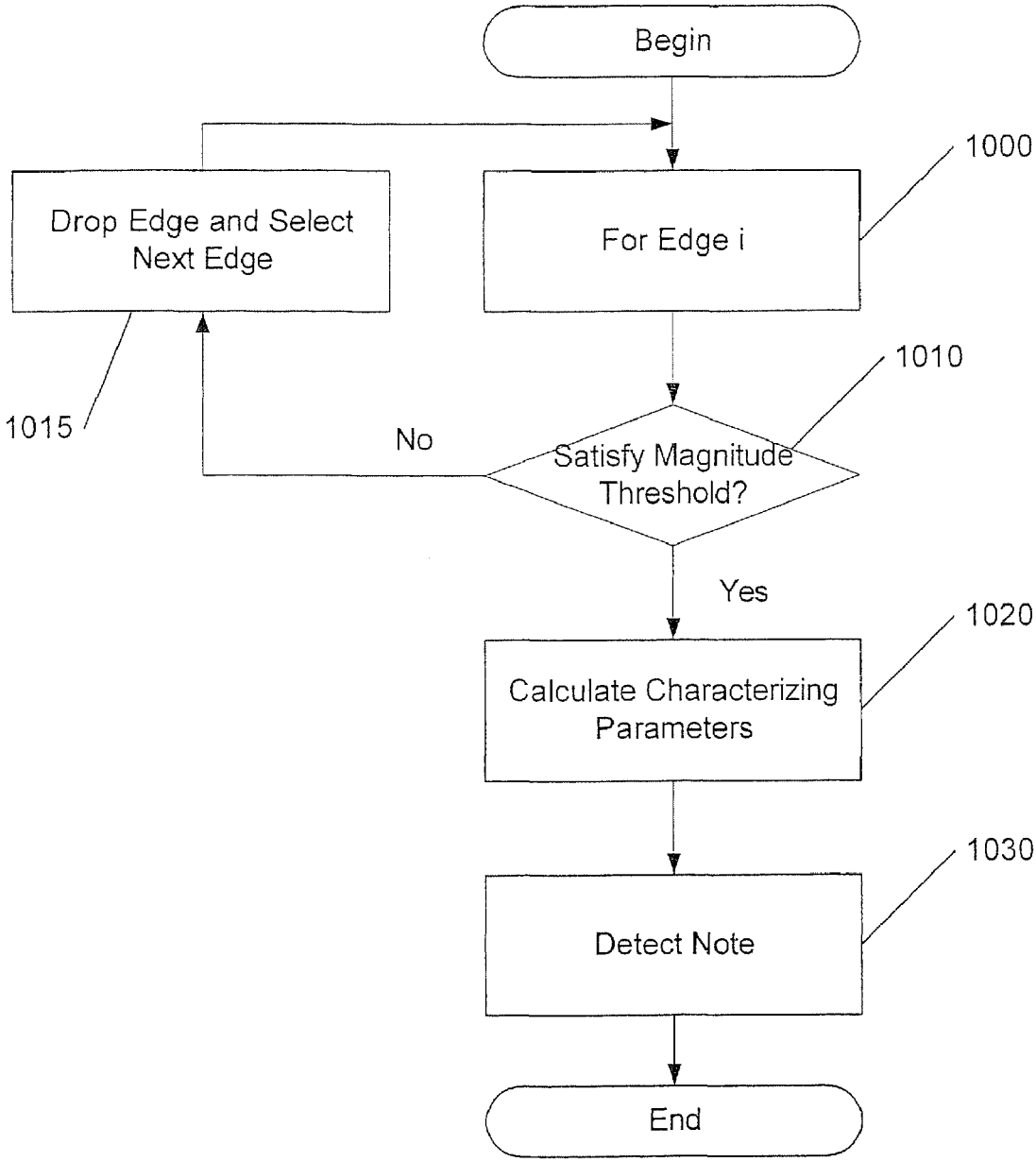

Operations for detecting a note according to further embodiments of the present invention will now be described with reference to the flow chart illustration of FIG. 10. For the embodiments of FIG. 10, before providing a detected edge to the note detection module 66 (FIG. 2) from the edge detection 65 (FIG. 2), each edge is processed through Blocks 1000-1015. For each edge (Block 1000) a magnitude of an edge signal in the edge detection signal (i.e., a pulse in the edge detector output) is detected and it is determined if the magnitude of the edge signal satisfies a threshold criteria (Block 1010). If the magnitude of the edge signal fails to satisfy the threshold criteria, the associated edge is discarded/dropped from consideration as being an edge indicative of being a signal edge/note that is to be detected and a next edge is selected for processing (Block 1015). For example, the threshold criterion applied at Block 1010 may correspond to a minimum magnitude associated with a musical instrument generating the note. A keystroke on a piano, for example, can only be struck so softly. For each edge satisfying the threshold criterion at Block 1010, characterizing parameters are calculated (Block 1020). More particularly, it will be understood that the characterizing parameters at Block 1020 are based on a time domain representation for a time period associated with the detected edge in the time domain representation. In other words, the characterizing parameters are based on shape and other characteristics of the signal in the time domain representation, not in the output signal of the edge detector utilized to identify an edge for analysis. Thus, the edge detector output is synchronized on a time basis to the time domain representation so that characterizing parameters may be generated based on the time domain representation and associated with individual detected edges by the edge detector. The note is then detected based on the calculated characterizing parameters of the time domain representation (Block 1030).

Figure 11:
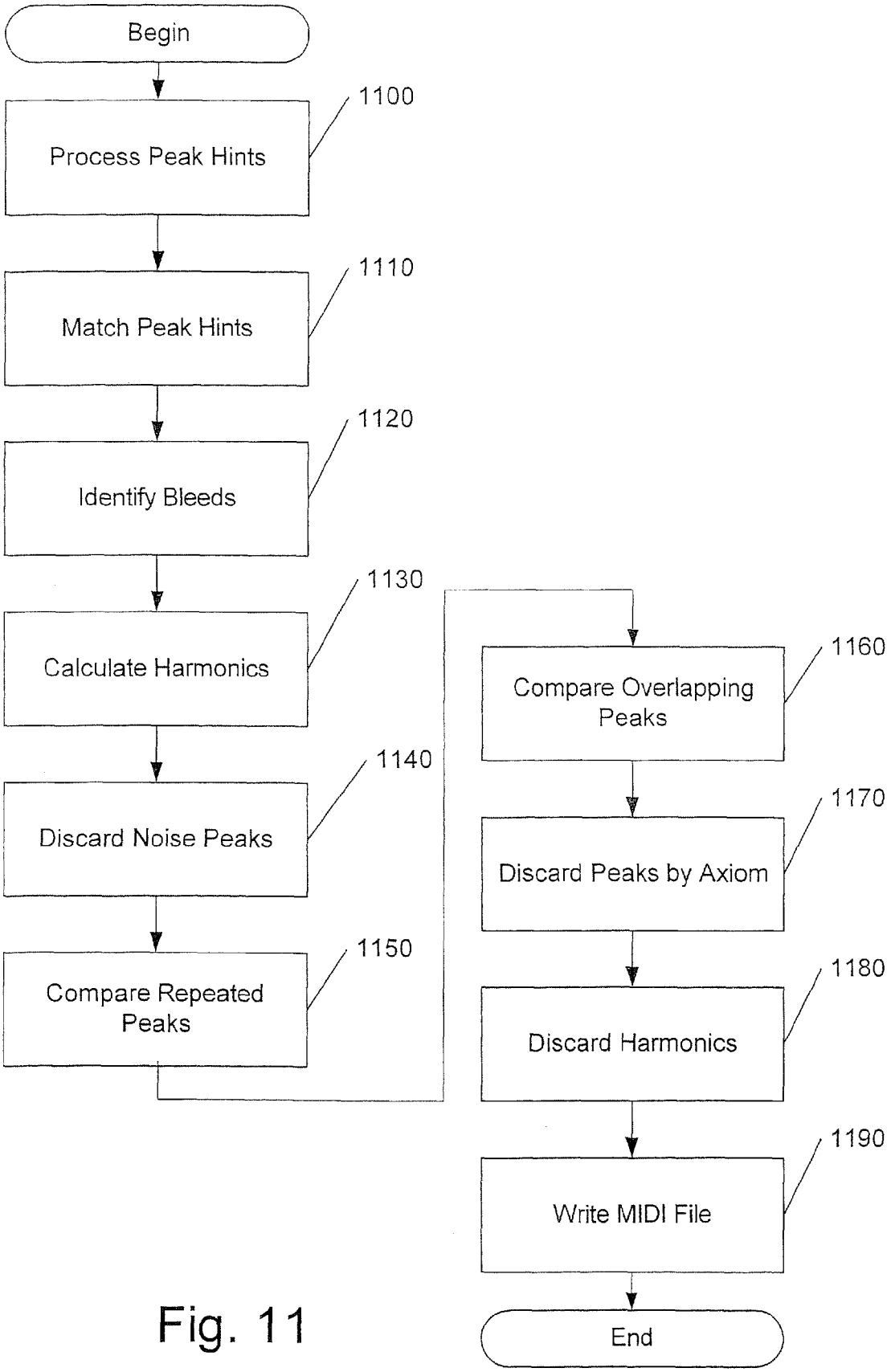

Further embodiments of the present invention will now be described with reference to the flow chart illustration of FIG. 11. FIG. 11 illustrates particular embodiments of operations for detecting a note including various different evaluation operations that may distinguish a musical note from a harmonic, bleed and/or other noise. However, it will be understood that, in different embodiments of the present invention, different combinations of these various evaluation operations may be utilized and that not all of the described operations need be executed in various embodiments of the present invention to detect a note. The particular combination of operations described with reference to FIG. 11 is provided to enable those of skill in the art to practice each of the different operations related to note detection alone or in combination with other of the described methodologies. Further details of various of these operations will be described with reference to FIGS. 12 and 13.

Referring now to the particular embodiments of FIG. 11, operations related to detecting a note begin at Block 1100 by what will be referred to herein as processing peak hints. Peak hints in this context refers to "hints" from a second and third edge detector output that an edge detected in the output signal from the first or primary edge detector is more likely to be indicative of the presence of a musical note or other desired signal edge.

Figure 6:
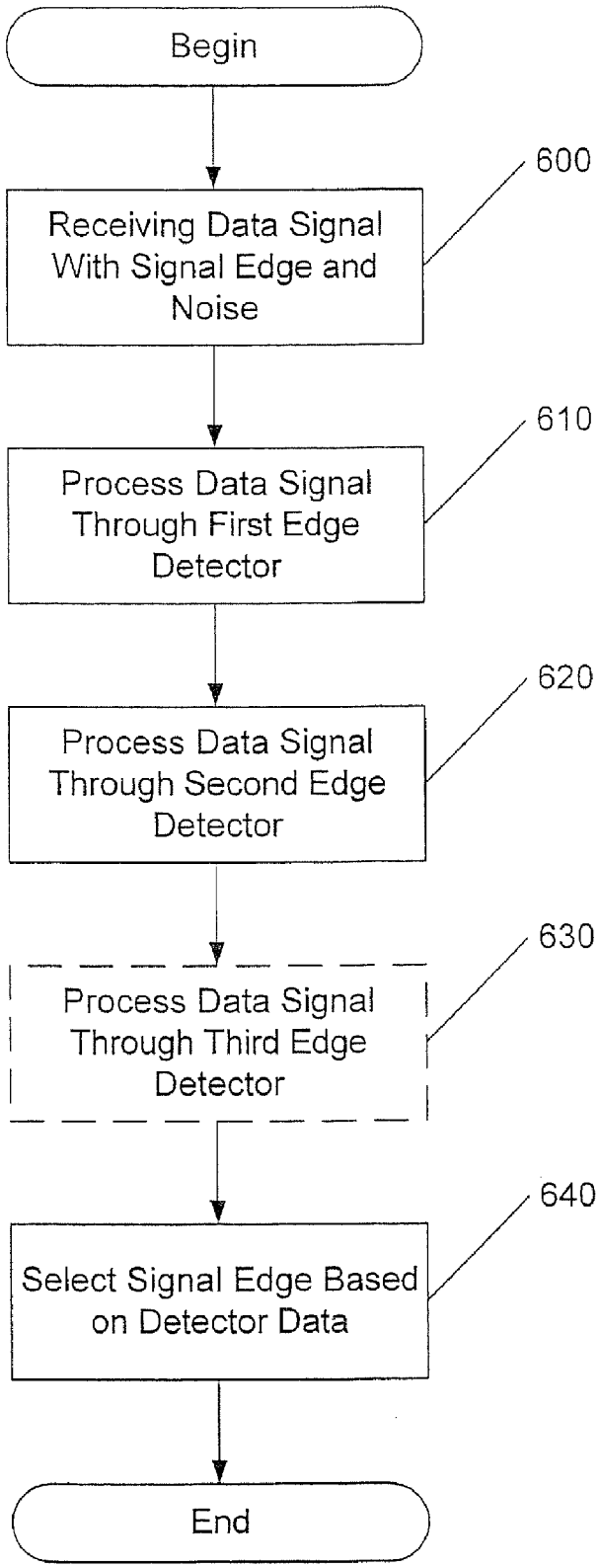
FIG. 6 is a flow chart illustrating operations for detecting an edge according to some embodiments of the present invention.

Thus, in the context of the multiple edge detector embodiments illustrated in FIG. 6, operations at Block 1100 may include, for each edge detected in the output from the second edge detector, retaining a detected edge in the second edge detection data when no adjacent edge in the second edge detection data is detected less than a minimum time displaced from the detected edge that has a higher magnitude than a particular detected edge. In other words, a detected edge from the second or third edge detector may be treated as valid if no adjacent object (detected edge/peak) close in time has a greater magnitude than self. For example, if an edge detected at time unit 1000 has an amplitude of 3.5 while an edge with an amplitude of 4.0 is detected at time 1010, this adjacent peak at time 1010 has a greater magnitude than the peak at time 1000, which may indicate the earlier peak is invalid. Such screening may, for example, separate out bleeds from notes. Operations at Block 1100 may further attempt to determine if an object (peak/edge) identified as valid has a corresponding bleed to reinforce the conclusion of a valid peak.

Further operations in processing peak hints at Block 1100 may include retaining a detected edge in the second edge detection data when a width associated with the detected edge fails to satisfy a threshold criteria. In other words, in isolation, where the width before or after the peak point for an edge is too narrow, this may indicate that the detected peak/edge is not a valid hint. In particular embodiments of the present invention, an edge from the second or third edge detector need satisfy only one and not necessarily both of these criteria.

Following processing of the peak hints at Block 1100, peak hints are matched (Block 1110). Operations at Block 1110 may include first determining if a detected edge in the first edge detection data corresponds to a retained detected edge in the second detection data and then determining that the detected edge in the first edge detection data is more likely to correspond to the note when the detected edge in the first edge detected data is determined to a correspond retained detected edge in the second edge detection data. Thus, operations at Block 1110 may include processing through each edge identified by the first edge detector and looking through the set of possibly valid peak hints from Block 1100 to determine if any of them are close enough in time and match the note/pitch of the edge indication from the first peak detector being processed (i.e., correspond to the same pitch and occur at the same time indicating that the peak hint makes the likelihood that the edge detected by the first edge detector corresponds to a note greater).

Operations at Block 1120 relate to identifying bleeds to distinguish bleeds from fundamental notes to be detected. Operations at Block 1120 include determining, for a detected edge, if another of the plurality of the detected edge is occurring at about the same time as the detected edge corresponds to a pitch associated with a bleed of the pitch associated with the time domain representation of the detected edge. A lower magnitude one of the detected edge and the other of the plurality of edges is discarded if the other edge is determined to be associated with a bleed of the pitch associated with the time domain representation of the detected edge. In other words, for each peak A (i.e., every peak), for each peak B (i.e., look at every other peak in the set), if the peaks are close in time and at an adjacent pitch (for example, on a keyboard generating the musical notes), then discard as a bleed whichever of the related adjacent peaks has a lower peak value amplitude. In addition, in some embodiments of the present invention, a likelihood of being a note value is increased for the retained peak as detecting the bleed may indicate that the retained peak is more likely to be a musical note.

Operations at Block 1130 relate to calculating harmonics in the detected peaks (edges). Note that, for the embodiments illustrated in FIG. 11, while harmonics are calculated at Block 1130, operations related to discarding of harmonics occur at Block 1180 following the intervening operations at Block 1140 to 1170 may determine that a peak calculated as a harmonic at Block 1130 is actually a fundamental. Operations at Block 1130 may include, for each detected edge, determining if others of the plurality of detected edges having a common associated time of occurrence as the detected edge correspond to a harmonic of the pitch associated with the time domain representation of the detected edge. It may then be determined that a detected edge is more likely to correspond to a note when it is determined that other of the plurality of detected edges correspond to a harmonic. Similarly, a detected edge may be less likely to correspond to a note when it is determined that none of the other of the plurality of detected edges correspond to a harmonic. In addition, a detected edge may be found less likely to correspond to a note when it is determined that a detected edge itself corresponds to a harmonic of another of the detected edges.

In particular embodiments of the present invention, harmonic calculation operations may be carried for the first through the eighth harmonics to determine if one or more of these harmonics exist. In other words, operations may include, for each peak A (each peak in the set), for each peak B (every other peak in the set), for each harmonic (numbers 1-8), if peak B is a harmonic of peak A, identifying peak B as corresponding to one of the harmonics of peak A.

In some embodiments of the present invention, operations at Block 1130 may further include, for each peak, calculating a slope of the harmonics as described previously with reference to the embodiments of FIG. 4. In general, it has been found that a negative slope with progressive harmonics from the fundamental indicates that the higher pitch detected peaks correspond to harmonics of a lower pitch peak. A simple linear least squares fit approximation may be used in determining the slope.

Operations related to discarding noise peaks are carried out at Block 1140 of FIG. 11. Various approaches to dropping likely noise peaks to narrow down the possible peaks/edges to be further evaluated to determine if they are notes may be based on a variety of different alternative approaches. Regardless of the approach, for ones of the detected plurality of edges/peaks, operations at Block 1140 include determining whether the detected edge corresponds to noise rather than a note based on characterizing parameters associated with the time domain representation corresponding to the detected edge and discarding the detected edge when it is determined to correspond to noise. The determination of whether a detected edge corresponds to noise may be, for example, score based, based on a decision tree type of inferred set of rules developed based on data generated from known notes and/or based on some other form of fixed set of rules.

Figure 12:
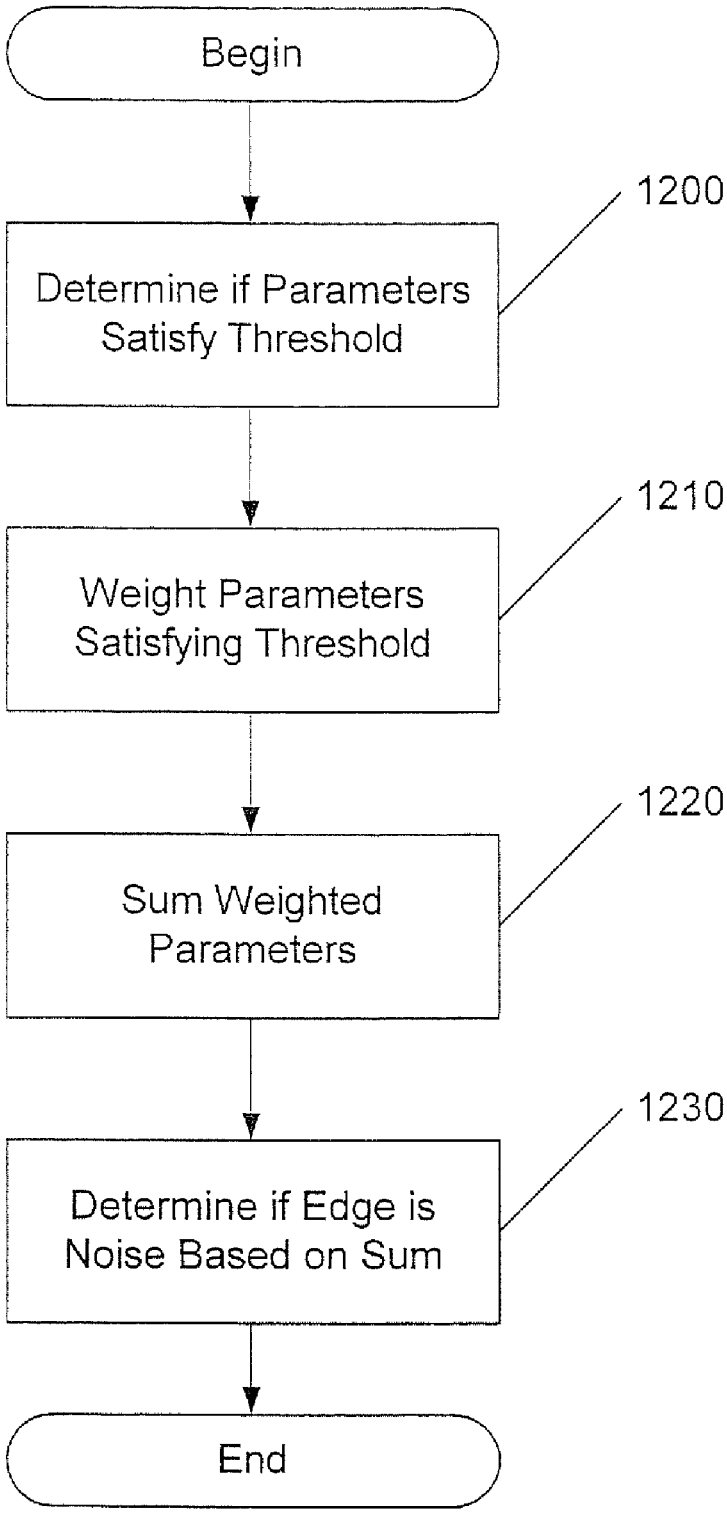

Particular embodiments of a score based approach to the operations for determining whether a detected edge corresponds to noise at Block 1140 are illustrated in the flow chart diagram of FIG. 12. As shown in FIG. 12, it is determined if the characterizing parameters associated with the time domain representation of a detected edge satisfy corresponding threshold criteria (Block 1200). Such a determination may be made for each of the plurality of characterizing parameters generated for an edge as described previously. The characterizing parameters are weighted if it is determined that they satisfy their corresponding threshold criteria based on assigned weighting values for the respective characterizing parameters (Block 1210). The weighting parameters may be obtained, for example, from the parameter weight data 71 (FIG. 2). The weighted characterized parameters are summed (Block 1220). It is then determined that a detected edge corresponds to noise when the summed weighted characterizing parameters fail to satisfy a threshold criterion (Block 1230). Note that the peak hint information generated at Block 1110 of FIG. 11 may be weighted and used in determining whether a detected edge corresponds to noise at Block 1140. It will be understood that, as noted above, operations at Block 1140 need not proceed as described for the particular embodiments of FIG. 12 and may be based, for example, on a rules decision tree generated based on reference characterizing parameters generated from known musical notes.

Operations at Block 1150 of FIG. 11, unlike the preceding operations described with reference to FIG. 11, are directed to adding back peak/edges that are dropped based on the preceding operations. In particular, peaks dropped at Block 1140 may, on a rules basis, be added back at Block 1150. In particular, operations at Block 1150 may include comparing peak magnitudes of retained detected edges to peak magnitudes of adjacent discarded detected edges from a same time domain representation. The adjacent discarded detected edges may be retained if they have a greater magnitude than the corresponding retained detected edges. In other words, the analysis of Block 1140 is expanded from an individual edge/peak to look at adjacent and time peaks to determine if a rejected peak should be used for further processing rather than a retained adjacent in time peak.

At Block 1160, overlapping peaks are compared to identify the presence of duplicate peaks/edges. For example, if a peak occurs at a time 1000 having a duration of 200 and a second peak occurs at a time 1100 having a duration of 200 from a known piano generated audio signal, both peaks could not be notes, as only one key of the pitch could have been struck and it is appropriate to pick the better of the two overlapping peaks and discard the other. The selection of better peak may be based on a variety of criteria including magnitude and the like.

Figure 13:
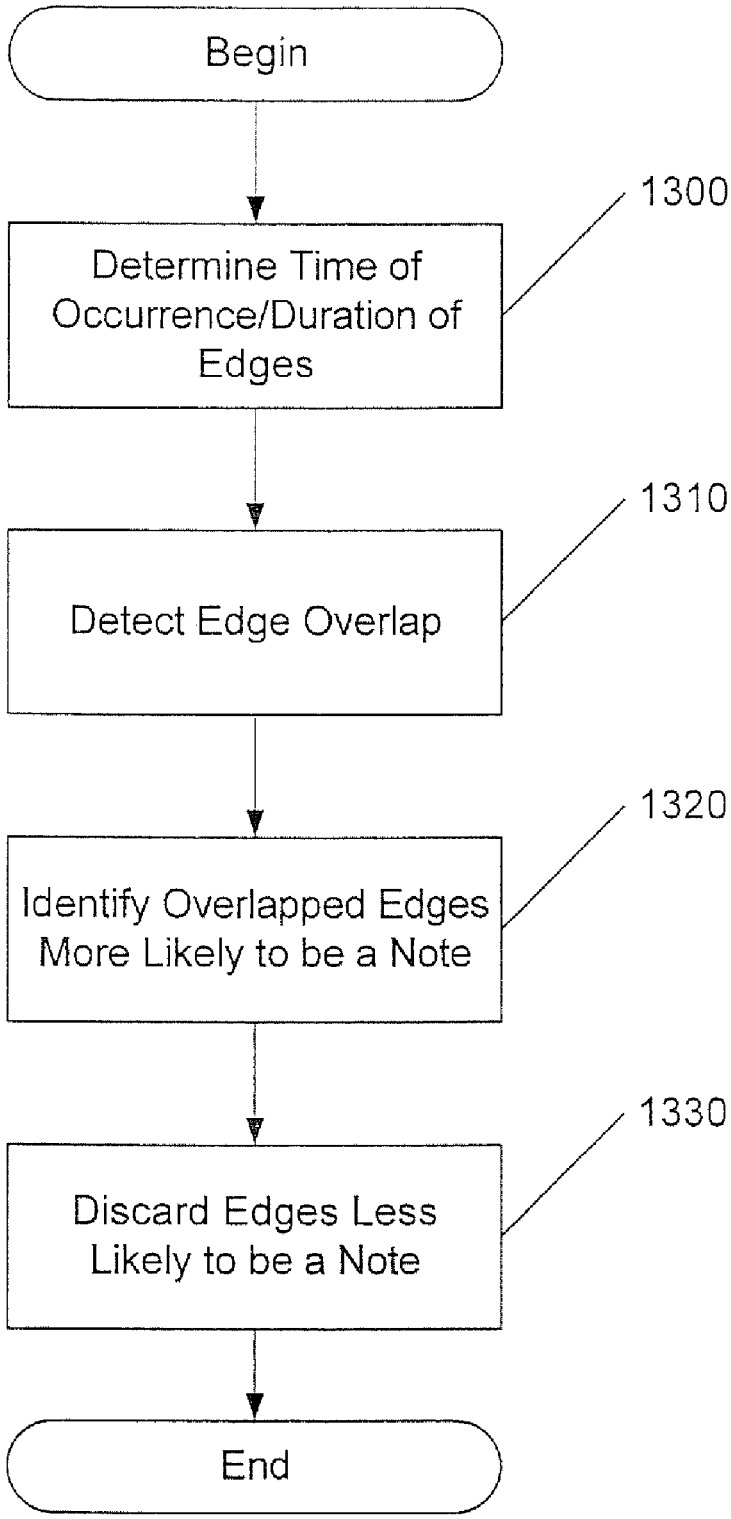

Operations for comparing overlapping peaks at Block 1160 will now be further described for particular embodiments of the present invention illustrated by the flow chart diagram of FIG. 13. A time of occurrence and a duration of each of the detected edges in a same time domain representation are determined (Block 1300). An overlap of detected edges based on the time of occurrence and duration of the detected edges is detected (Block 1310). It is then determined which of the overlapping detected edges has a greater likelihood of corresponding to a musical note (Block 1320). The overlapping edges not have a greater likelihood of corresponding to a musical note are discarded (Block 1330).

Referring again to FIG. 11, additional peaks are discarded by axiom (Block 1170). In other words, characterizing parameters associated with a time domain representation for a time period associated with a detected edge/peak in the time domain representation are evaluated and the detected edge/peak is discarded if one of the determined characterizing parameters fails to satisfy an associated threshold criterion, which may be based on known characteristics of a mechanical action generating a note. For example, one suitable characterizing parameter is a peak amplitude/magnitude failure. As it is only physically possible to play a note on a particular instrument so softly, the detected magnitude may be mapped to a corresponding velocity for a given pitch and if a negative velocity of strike is detected, the edge/peak may be rejected by axiom as it is not possible to have a negative velocity strike, for example, of a piano key. Operations at Block 1170 may also include, for example, discarding of bleeds, discarding of peak/edges having an associated pitch that cannot be played by the musical instrument, such as the piano keyboard, and the like. In other words, the axioms applied at Block 1170 are generally based on characteristics associated with an instrument generating the musical notes that are to be detected.

As described above with reference to Block 1130, following the other described edge discarding operations, detected edges corresponding to a harmonic may be discarded at Block 1180.

Finally, a MIDI file or other digital record of the detected notes may be written (Block 1190). In other words, while operations above have generally been described with reference to detecting an individual musical note, it will be understood that a plurality of notes associated with a musical score may be detected and operations to Block 1190 may generate a MIDI file, or the like, for the musical score. For example, with known high quality MIDI file standards, detailed information characterizing a note may be saved for each note including a start time, duration, a peak value (which may be mapped to a note on velocity and further a note off velocity that would be determined based on the note on velocity and the duration). The note information will also include the corresponding pitch of the note.

As discussed with reference to various embodiments of the present invention above, duration of a note may be determined. Operations for determining duration according to particular embodiments of the present invention will now be described. A duration determining process may include, among other things, computing the duration of a note and determining a shape and decay rate of an envelope associated with the note. These calculations may take into account peak shape, which may depend on the instrument being played to generate the note. These calculations may also consider physical factors, such as shape of the signal, delay from when the note was played until its corresponding frequency signals show up, how hard or rapidly the note is played, which may change delay and frequency dependent aspects, such as possible changes in decay and extinction characteristics.

As used herein, the term "envelope" refers to the Fourier data for a single frequency (or bin of the frequency transforms). A note is a longer duration event in which the Fourier data may vary wildly and may contain multiple peaks (generally smaller than the primary peak) and will generally have some amount of noise present. The envelope can be the Fourier data itself or an approximation/idealization of the same data. The envelope may be used to make clear when the note being played starts to be damped, which may indicate that the note's duration is over. Once the noise is reduced and effects from adjacent notes being played are reduced or removed, the envelope for a note may appear with a sharp rise on the left (earlier in time) followed by a peak and then a gentle decay for a while, finishing with a downturn in the graph indicating the damping of the note.

In some embodiments of the present invention, the duration calculation operations determine how long a note is played. This determination may involve a variety of factors. Among these factors is the presence of a spectrum of frequencies related to the note played (i.e., the fundamental frequency and the harmonics). These signal elements may have a limited set of shapes in time and frequency. An important factor may be the decay rate of the envelope of the note's elements. The envelope of these elements' waveforms may start decaying at a higher rate, which may indicate that some dampening factor has been introduced. For example, on a piano, a key might have been released. These envelopes may have multiple forms for an instrument, depending, for example, on the acoustics and the instrument being played. The envelopes may also vary depending on what other notes are being played at the same time.

Depending on the instrument being played, there are generally also physical factors that should be taken into account. For example, there is a generally a delay between when a string is plucked or struck and when it starts to sound. The force used to play the note may also affect the timing (e.g., pressing a piano key harder generally shortens the time until the hammer strikes the string). Frequency dependent responses are also taken into account in some embodiments of the present invention. Among other factors that may affect the duration computations are the rate of change of the decay and extinction, e.g., with a flute there is typically a marked difference in the decay of a note depending on whether the player stopped blowing or the player changed the note being played.

The duration determining process in some embodiments of the present invention begins at a start point on a candidate note, for example, on the fundamental frequency. The start point may be the peak of the envelope for that frequency. The algorithm processes forward in time, computing a number of decay and curvature functions (such as first and second derivative and curvature functions with relative minimums and maximums) which are then evaluated looking for a terminating condition. Examples of terminating conditions include significant change in rate of decay, start of a new note and the like (which may appear as drops or rises in the signal. Distinct duration values may be generated for a last change in the signal envelope and based on a smooth envelope change. These terminating conditions and how the duration is calculated may depend on the shape of the envelope, of which there may be several different kinds depending on a source instrument and acoustic conditions during generation of the note.

The harmonic frequencies may also have useful information about the duration of a note and when harmonic information is available (e.g., no note being played at the harmonic frequency), the harmonic frequencies may be evaluated to provide a check/verification of the fundamental frequency analysis.

The duration determination process may also resolve any extraneous information in the signal such as noise, adjacent notes being played and the like. The signal interference sources may appear in peaks, pits or as spikes in the signal. In some cases there will be a sharp downward spike that might be mistaken for the end of a note that is really just an interference pattern. Similarly an adjacent note being played will generally cause a bleed peak, which could be mistaken for the start of a new note.

The flowcharts and block diagrams of FIGS. 1 through 13 illustrate the architecture, functionality, and operation of possible implementations of systems, methods and computer program products according to various embodiments of the present invention. It should also be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be understood that each block of the block diagrams and/or flowchart illustrations, and combinations of blocks in the block diagrams and/or flowchart illustrations, can be implemented by special purpose hardware-based systems which perform the specified functions or acts, or combinations of special purpose hardware and computer instructions.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

That which is claimed is:

1. A method for detection of a note, comprising:

generating a plurality of frequency domain representations of an audio signal over time;

generating a time domain representation from the plurality of frequency domain representations;

detecting a plurality of edges in the time domain representation; and detecting the note by selecting one of the plurality of edges as corresponding to the note based on characteristics of the time domain representation.

2. The method of claim 1 wherein:

generating a plurality of frequency domain representations comprises generating a plurality of sets of frequency domain representations of the audio data signal over time, each of the sets being associated with a different pitch;

generating a time domain representation comprises generating a plurality of time domain representations from the respective sets, each of the time domain representations being associated with one of the different pitches; and detecting a plurality of edges comprises detecting a plurality of edges in at least one of the time domain representations.

3. The method of claim 2 wherein detecting a plurality of edges comprises detecting edges in at least two of the time domain representations and wherein detecting a note comprises:

identifying one of the edges in a first one of the time domain representations as corresponding to a fundamental of the note; and identifying one of the edges in a different one of the time domain representations as corresponding to a harmonic of the note.

4. The method of claim 2 wherein detecting a note comprises:

grouping edges from time domain representations associated with different pitches having a common associated time of occurrence;

determining magnitudes associated with the grouped edges;

determining a slope defined by changes in the determined magnitudes with changes in pitch; and detecting a note based on the determined slope.

5. The method of claim 2 wherein detecting a note further comprises determining a duration of the note.

6. The method of claim 5 wherein the duration is associated with a mechanical action generating the note.

7. The method of claim 6 wherein the mechanical action comprises a key stroke.

8. The method of claim 2 wherein generating a plurality of sets of frequency domain representations of the audio data signal over time comprises:

defining frequency boundaries to provide a plurality of frequency ranges associated with each of the set of frequency domain representations corresponding to a different pitch, wherein the frequency ranges are non-uniform; and generating frequency domain representations over time for respective ones of the sets of frequency domain representations, each set of frequency domain representations being based on a corresponding one of the frequency ranges.

9. The method of claim 8 wherein defining frequency boundaries comprises providing non-uniform frequency ranges to provide a substantially uniform resolution for each of a plurality of pre-defined pitches corresponding to musical notes.

10. The method of claim 9 wherein defining frequency boundaries further comprises providing one of the plurality of frequency ranges for each of a plurality of pre-defined pitches corresponding to harmonics of musical notes.

11. The method of claim 2 wherein detecting a plurality of edges includes:

receiving edge detection signals based on respective ones of the time domain representations;

detecting a magnitude of an edge signal in the edge detection signals; and discarding consideration of the edge signal as an indicator of an edge if the magnitude of the edge signal fails to satisfy a threshold criterion.

12. The method of claim 11 wherein the threshold criterion corresponds to a minimum magnitude associated with a musical instrument generating the note.

13. The method of claim 2 wherein detecting a note comprises:

calculating characterizing parameters associated with one of the time domain representations for a time period associated with one of the detected plurality of edges in the one of the time domain representations; and detecting the note based on the calculated characterizing parameters of the time domain representation.

14. The method of claim 13 wherein characterizing parameters associated with one of the time domain representations for a time period associated with one of the detected plurality of edges in the one of the time domain representations includes calculating a measure of smoothness of the one of the time domain representations.

15. The method of claim 14 wherein calculating a measure of smoothness comprises:

calculating a logarithm of the one of the time domain representations for at least a portion of the time period;

calculating a running average function of the logarithm of the one of the time domain representations; and comparing the calculated logarithm and running average function to provide the measure of smoothness.

16. The method of claim 15 wherein comparing the calculated logarithm and running average function comprises:

determining differences between the logarithm and the running average function; and summing the determined differences over a calculation window to provide the measure of smoothness.

17. The method of claim 16 wherein comparing the calculated logarithm and running average function further comprises determining a number of slope direction changes in the logarithm in a count time window around an identified peak in the logarithm corresponding to the one of the detected plurality of edges.

18. The method of claim 13 wherein the characterizing parameters associated with the one of the time domain representations include at least one of: a run length of the measure of smoothness satisfying a threshold criterion; a peak run length of the measure of smoothness satisfying a threshold criterion starting at a peak point corresponding to a maximum magnitude of the one of the time domain representations; a maximum magnitude; a duration; wave shape properties; a time associated with the maximum magnitude; and/or a relative magnitude from a determined minimum peak time magnitude value to a determined maximum peak time magnitude value.

19. The method of claim 18 wherein detecting a note further comprises calculating characterizing parameters associated with one of the edge detection signals corresponding to the one of the time domain representations for a time period associated with the one of the detected plurality of edges and wherein detecting the note further comprises detecting the note based on the calculated characterizing parameters of the edge detection signal.

20. The method of claim 18 wherein detecting the note comprises, for the one of the detected plurality of edges:

determining whether the detected edge corresponds to noise rather than a note based on the characterizing parameters associated with the one of the time domain representations; and discarding the detected edge when it is determined to correspond to noise.

21. The method of claim 2 wherein detecting the note further comprises:

determining a time of occurrence and a duration of each of the detected edges in a same time domain representation;

detecting an overlap of detected edges based on the time of occurrence and duration of the detected edges;

determining which of the overlapping detected edges has a greater likelihood of corresponding to a musical note; and discarding overlapping edges not having a greater likelihood of corresponding to a musical note.

22. The method of claim 2 wherein detecting the note further comprises:

determining characterizing parameters associated with one of the time domain representations for a time period associated with one of the detected plurality of edges in the one of the time domain representations; and discarding the one of the detected plurality of edges if one of the determined characterizing parameters fails to satisfy an associated threshold criterion based on known characteristics of a mechanical action generating the note.

23. The method of claim 22 wherein the known characteristics include strike velocity and wherein determining characterizing parameters comprises:

measuring a peak magnitude associated with the one of the time domain representations for the time period; and determining an estimated strike velocity for the mechanical action generating the note based on the measured peak magnitude; and wherein discarding the one of the detected plurality of edges comprises discarding the one of the detected plurality of edges if the estimated strike velocity is less than zero.

24. The method of claim 22 wherein the known characteristics include a pitch range for an instrument generating the note and wherein determining characterizing parameters comprises determining a pitch associated with the one of the time domain representations and wherein discarding the one of the detected plurality of edges comprises discarding the one of the detected plurality of edges if the determined pitch is outside the pitch range.

25. The method of claim 2 wherein detecting a note comprises detecting a plurality of notes associated with a musical score and wherein the method further comprises generating a MIDI file for the musical score.

26. The method of claim 25 wherein each of the notes in the MIDI file is characterized by a start time and a pitch and at least one of a duration, a note strike velocity and/or a note release velocity.

27. The method of claim 26 wherein the note strike velocity is based on a peak magnitude value of a detected edge corresponding to the note and wherein the note release velocity is based on the note strike velocity and the duration.

28. The method of claim 2 wherein generating a plurality of frequency domain representations comprises generating a plurality of fast fourier transforms (FFTs).

29. The method of claim 28 wherein the FFTs have a resolution of at least about 10 milliseconds.

30. The method of claim 29 wherein, for selected time windows for frequency domain ranges associated with expected musical notes of the FFTs where an edge is detected are further evaluated based on FFTs having a resolution of at least about 1 millisecond to further evaluate a start time and/or duration for the note.

31. A system for detection of a note, comprising:

a frequency domain module that generates a plurality of frequency domain representations of an audio signal over time;

a time domain module that generates a time domain representation from the plurality of frequency domain representations;

an edge detection module that detects a plurality of edges in the time domain representation; and a note detection module that detects the note by selecting one of the plurality of edges as corresponding to the note based on characteristics of the time domain representation.

32. A computer program product for detecting a note, comprising:

a computer readable medium having computer readable program code embodied therein, the computer readable program code comprising:

computer readable program code configured to generate a plurality of frequency domain representations of an audio signal over time;

computer readable program code configured to generate a time domain representation from the plurality of frequency domain representations;

computer readable program code configured to detect a plurality of edges in the time domain representation; and computer readable program code configured to detect the note by selecting one of the plurality of edges as corresponding to the note based on characteristics of the time domain representation.

* * * * *

UNITED STATES PATENT AND TRADEMARK OFFICE

CERTIFICATE OF CORRECTION

PATENT NO. : 8,008,566 B2
APPLICATION NO. : 12/556926
DATED : August 30, 2011
INVENTOR(S) : Walker, II et al.

It is certified that error appears in the above-identified patent and that said Letters Patent is hereby corrected as shown below:

Column 5, Line 20: Please correct "instructions Nay" to read -- instructions may --

Signed and Sealed this
Tenth Day of January, 2012

David J. Kappos
*Director of the United States Patent and Trademark Office*